US010781405B2

(12) United States Patent
Murphy et al.

(10) Patent No.: US 10,781,405 B2
(45) Date of Patent: Sep. 22, 2020

(54) POLYETHERAMINE COMPOSITIONS FOR LAUNDRY DETERGENTS

(71) Applicant: STEPAN COMPANY, Northfield, IL (US)

(72) Inventors: Dennis S. Murphy, Libertyville, IL (US); Franz J. Luxem, Palatine, IL (US); Patrick Shane Wolfe, Palatine, IL (US)

(73) Assignee: STEPAN COMPANY, Northfield, IL (US)

( * ) Notice: Subject to any disclaimer, the term of this patent is extended or adjusted under 35 U.S.C. 154(b) by 53 days.

(21) Appl. No.: 16/193,143

(22) Filed: Nov. 16, 2018

(65) Prior Publication Data

US 2019/0085266 A1 Mar. 21, 2019

Related U.S. Application Data

(63) Continuation of application No. PCT/US2017/030394, filed on May 1, 2017.

(60) Provisional application No. 62/339,156, filed on May 20, 2016.

(51) Int. Cl.

| | |
|---|---|
| ***C11D 1/00*** | (2006.01) |
| ***C11D 1/12*** | (2006.01) |
| ***C11D 1/72*** | (2006.01) |
| ***C11D 3/37*** | (2006.01) |
| ***B08B 3/04*** | (2006.01) |
| ***C11D 11/00*** | (2006.01) |
| ***C11D 3/30*** | (2006.01) |
| ***C11D 1/14*** | (2006.01) |
| ***C11D 1/22*** | (2006.01) |
| ***C11D 1/66*** | (2006.01) |
| *C11D 3/00* | (2006.01) |
| *C11D 3/386* | (2006.01) |

(52) U.S. Cl.

CPC ..... *C11D 3/3723* (2013.01); *C11D 1/143* (2013.01); *C11D 1/146* (2013.01); *C11D 1/22* (2013.01); *C11D 1/662* (2013.01); *C11D 1/72* (2013.01); *C11D 3/30* (2013.01); *C11D 3/3707* (2013.01); *C11D 3/3792* (2013.01); *C11D 11/0017* (2013.01); *C11D 3/0036* (2013.01); *C11D 3/38663* (2013.01)

(58) Field of Classification Search

CPC .. C11D 1/00; C11D 1/12; C11D 1/662; C11D 1/72; C11D 3/37; C11D 3/3723; B08B 3/04

See application file for complete search history.

(56) References Cited

U.S. PATENT DOCUMENTS

| | | | |
|---|---|---|---|
| 3,332,880 | A | 7/1967 | Kessler et al. |
| 3,664,961 | A | 5/1972 | Norris |
| 3,929,678 | A | 12/1975 | Laughlin et al. |
| 3,968,169 | A | 7/1976 | Seiden et al. |
| 4,228,044 | A | 10/1980 | Cambre |
| 4,265,774 | A | 5/1981 | Langdon et al. |
| 4,353,307 | A | 10/1982 | Munson |
| 4,507,219 | A | 3/1985 | Hughes |
| 4,548,744 | A | 10/1985 | Connor |
| 4,561,998 | A | 12/1985 | Wertz |
| 4,597,989 | A | 7/1986 | Wonsowicz et al. |
| 4,766,245 | A | 8/1988 | Larkin et al. |
| 4,912,260 | A | 3/1990 | Dobson et al. |
| 4,960,953 | A | 10/1990 | Jakobson et al. |
| 4,973,763 | A | 11/1990 | Jakobson et al. |
| 5,015,773 | A | 5/1991 | Dobson |
| 5,071,594 | A | 12/1991 | Borland et al. |
| 5,075,501 | A | 12/1991 | Borland et al. |
| 4,663,071 | B1 | 4/1992 | Bush et al. |
| 5,159,101 | A | 10/1992 | Champion et al. |
| 5,170,350 | A | 12/1992 | Kamimura et al. |
| 5,243,086 | A | 9/1993 | Jakobon et al. |
| 5,349,094 | A | 9/1994 | Harris et al. |
| 5,352,835 | A | 10/1994 | Dai et al. |
| 5,446,394 | A | 8/1995 | Cassidy |

(Continued)

FOREIGN PATENT DOCUMENTS

| | | | |
|---|---|---|---|
| DE | 2247832 | A1 | 4/1973 |
| EP | 0075996 | A2 | 4/1983 |

(Continued)

OTHER PUBLICATIONS

PCT International Search Report and Written Opinion dated Sep. 4, 2017 from Application No. PCT/US2017/030394, 14 pages.
Morinaka et al., Org. Lett. 9 (2007) No. 25, pp. 5219-5222.
Wessig et al., Synlett (1977), pp. 893-894.
Prasad et al., Tetrahedron 58 (2002) 7355-7363.
Han et al., Peptide Res. 58 (2001) 338.
Amundsen et al., J. Am. Chem. Soc. 73 (1951) 242.

*Primary Examiner* — Brian P Mruk

(74) *Attorney, Agent, or Firm* — Dilworth IP, LLC

(57) ABSTRACT

Detergent compositions comprising one or more surfactants and a polyetheramine composition are disclosed. The polyetheramine composition comprises a compound having a polyglycerol core and an aminoalkyl group or an oxidized aminoalkyl group that is bonded directly or indirectly to each available oxygen of the polyglycerol core. Optionally, oxyalkylene groups link available oxygens of the polyglycerol core to the aminoalkyl or oxidized aminoalkyl groups. Methods for laundering textile articles and other cleaning methods using the detergent compositions are also disclosed. The polyetheramines can use diglycerol, a convenient plant-based starter. Laundry detergents comprising the polyetheramines provide enhanced cold-water cleaning performance for greasy or oily stains compared with similar detergents formulated without the polyetheramines.

20 Claims, No Drawings

(56) References Cited

U.S. PATENT DOCUMENTS

| | | | | |
|---|---|---|---|---|
| 5,470,813 | A | 11/1995 | Le-Khac | |
| 5,482,908 | A | 1/1996 | Le-Khac | |
| 5,576,282 | A | 11/1996 | Miracle et al. | |
| 5,616,811 | A | 4/1997 | Vipond et al. | |
| 5,622,925 | A | 4/1997 | De Buzzaccarini et al. | |
| 5,679,630 | A | 10/1997 | Baeck et al. | |
| 5,696,293 | A | 12/1997 | Phillips et al. | |
| 5,817,593 | A | 10/1998 | Chang et al. | |
| 5,929,022 | A | 7/1999 | Velazquez | |
| 6,017,871 | A | 1/2000 | Baeck et al. | |
| 6,306,812 | B1 | 10/2001 | Perkins et al. | |
| 6,326,348 | B1 | 12/2001 | Vinson et al. | |
| 6,376,713 | B1 | 4/2002 | Baiker et al. | |
| 6,878,695 | B2 | 4/2005 | Woo et al. | |
| 6,949,498 | B2 | 9/2005 | Murphy et al. | |
| 7,326,675 | B2 | 2/2008 | Schneiderman et al. | |
| 7,335,801 | B2 | 2/2008 | Endo et al. | |
| 2002/0187909 | A1 | 12/2002 | Gupta et al. | |
| 2015/0057212 | A1* | 2/2015 | Hulskotter ..... | C11D 3/3723 510/320 |
| 2016/0075970 | A1 | 3/2016 | Hulskotter et al. | |
| 2016/0090561 | A1 | 3/2016 | Hulskotter et al. | |
| 2016/0090563 | A1 | 3/2016 | Loughnane et al. | |
| 2016/0090564 | A1* | 3/2016 | Loughnane ..... | C11D 1/38 510/320 |

FOREIGN PATENT DOCUMENTS

| | | | |
|---|---|---|---|
| EP | 111965 | A2 | 6/1984 |
| EP | 111984 | A2 | 6/1984 |
| EP | 112592 | A2 | 7/1984 |
| EP | 0070077 | B1 | 1/1987 |
| EP | 0094118 | B2 | 4/1993 |
| GB | 1082179 | A | 9/1967 |
| GB | 1372034 | A | 10/1974 |
| GB | 2075028 | B | 3/1984 |
| GB | 2095275 | B | 8/1985 |
| WO | 88/09367 | A1 | 12/1988 |
| WO | 92/05249 | A1 | 4/1992 |
| WO | 99/05242 | A1 | 2/1999 |
| WO | 2015144497 | A1 | 10/2015 |
| WO | 2015148360 | A1 | 10/2015 |
| WO | 2015148361 | A1 | 10/2015 |
| WO | 2015148890 | A1 | 10/2015 |
| WO | 2016049388 | A1 | 3/2016 |

* cited by examiner

POLYETHERAMINE COMPOSITIONS FOR LAUNDRY DETERGENTS

FIELD OF THE INVENTION

The invention relates to polyetheramine compositions and their use in laundry detergents.

BACKGROUND OF THE INVENTION

Polymers are widely used in laundry detergents. In addition to their use to promote soil removal, some polymers function as anti-redeposition agents, soil release agents, dye transfer inhibition agents, in-wash fabric softening agents, thickeners, anti-encrustation agents, builders, or anti-foam agents.

Soil removal agents are intended for primary cleaning, i.e., to improve removal of soil in one wash cycle. Polymers that have been taught for this purpose include, for example, acrylic acid/styrene copolymers, nylon polymer beads, diquaternium ethoxy sulfate, polyethyleneimine ethoxylates, and polyetheramines.

Among polyetheramines, most of the known products are made by reacting a diol or triol starter molecule with one or more equivalents of an alkylene oxide per hydroxyl equivalent, followed by amination to replace free hydroxyl groups with primary amino groups. See, for example, WO 2015/144497 and WO 2015/148360 (1,2-diol starters); U.S. Publ. Nos. 2016/0090561, 2016/0090563, and 2016/0075970 (2,2-dialkyl-1,3-propanediol starters); WO 2015/148890 (various diol starters); and U.S. Publ. No. 2015/0057212 (glycerol or 2-alkylglycerol starters).

U.S. Publ. No. 2016/0090564 describes polyetheramines made from pentaerythritol, a tetrol starter. Pentaerythritol has a melting point of 255-259° C., so reacting it efficiently and safely with alkylene oxides poses a technical challenge, usually requiring a large proportion of a solvent to form a liquid mixture at the reaction temperatures desirable for alkoxylation (typically 80-150° C.).

The industry would benefit from compositions that can be included in laundry detergents to boost soil removal performance, especially when the detergent is used for cold-water cleaning (i.e., water temperature about 30° C. or less). New polyetheramine alternatives are desirable, particularly compositions that would avoid the need to use a high-melting polyol starter. Ideally, the polyetheramines could utilize a renewable, plant material-based polyol starter.

SUMMARY OF THE INVENTION

In one aspect, the invention relates to a detergent composition. The composition comprises: (a) one or more nonionic, cationic, anionic, amphoteric, or zwitterionic surfactants; and (b) a polyetheramine composition. The polyetheramine composition comprises a compound having a polyglycerol core, which may be diglycerol or a higher polyglycerol. An aminoalkyl group or an oxidized aminoalkyl group (i.e., an amine oxide group) is bonded directly or indirectly to each available oxygen of the polyglycerol core. Optionally, one or more oxyalkylene groups link available oxygens (formerly free hydroxyl groups) of the polyglycerol core to the aminoalkyl or oxidized aminoalkyl groups. In other aspects, the invention includes methods for laundering textile articles and other cleaning methods using the inventive detergents.

Laundry detergent compositions comprising the polyetheramine compositions provide enhanced cold-water cleaning performance for greasy or oily stains (e.g., beef tallow or butter) compared with similar detergents formulated in the absence of the polyetheramines. Unlike polyetheramines made from pentaerythritol, the polyetheramines useful herein can utilize a renewable, plant-based alcohol starter (diglycerol). Moreover, because diglycerol is a liquid at room temperature, it is easily handled and reacted with alkylene oxides without the need for a solvent.

DETAILED DESCRIPTION OF THE INVENTION

In one aspect, the invention relates to detergent compositions. The detergent compositions comprise one or more surfactants and a polyetheramine composition.

The Polyetheramine Composition

The polyetheramine composition comprises a compound having a polyglycerol core. As used herein, "polyglycerol" refers to two or more glycerol units linked by an ether group. Suitable polyglycerols include diglycerol, higher polyglycerols, and their mixtures.

Polyglycerols can be linked by forming an ether group using two terminal hydroxyl groups, a terminal hydroxyl group and an internal hydroxyl group, or two internal hydroxyl groups. Usually, ethers from two terminal hydroxyl groups will predominate. Thus, diglycerol, the simplest of the polyglycerols, can exist in three distinct forms: α,α'-diglycerol, α,β-diglycerol, or β,β'-diglycerol. Depending on its method of preparation, "diglycerol" will often contain mostly α,α'-diglycerol, some higher polyglycerols, and traces of other components, including cyclic isomers. Preferably, the polyglycerol core is based on diglycerol or a mixture of diglycerol with higher polyglycerols, more preferably diglycerol.

Suitable diglycerol and polyglycerols are commercially available from Solvay and other suppliers. They can also be synthesized by known methods including alkaline condensation followed by hydrolysis, neutralization, and purification; reactions with halogenated reagents or intermediates; zeolite-catalyzed condensations; and other processes. For examples of suitable ways to make diglycerol and other polyglycerols, see U.S. Pat. Nos. 3,968,169; 4,265,774; 4,960,953; 4,973,763; 5,243,086; 5,349,094; 5,710,350; and 7,335,801, the teachings of which are incorporated herein by reference.

In the polyetheramine compositions, an aminoalkyl or oxidized aminoalkyl group is bonded directly or indirectly to each available oxygen of the polyglycerol core. By "available oxygen," we mean an oxygen atom that was part of a hydroxyl group in the polyglycerol. Thus, the ether oxygens linking glycerol units are not "available" oxygens in this context. In some aspects, the aminoalkyl or oxidized aminoalkyl group is bonded "directly" to the available oxygen via a carbon-oxygen bond. The aminoalkyl or oxidized aminoalkyl group can be linear or branched, and the amino group can be a primary, secondary, or tertiary amino group. In preferred aspects, the aminoalkyl or oxidized aminoalkyl group has 2 to 8 carbons on the chain that links the amino group to the available oxygen. The amino nitrogen can unsubstituted (i.e., it can have two hydrogens) or it can be substituted with one or two alkyl groups, preferably $C_1$-$C_{10}$ alkyl groups. In other aspects, the aminoalkyl or oxidized aminoalkyl group is bonded "indirectly" to the available oxygen. In this case, the optional oxyalkylene groups discussed below link the available oxygen to the aminoalkyl or oxidized aminoalkyl group. "Oxidized aminoalkyl group" refers to an amine oxide group. The aminoalkyl groups are conveniently oxidized to an amine oxide functionality using hydrogen peroxide or other oxidizing agents.

Optionally, one or more oxyalkylene groups link available oxygens of the polyglycerol core to the aminoalkyl or oxidized aminoalkyl groups. Suitable oxyalkylene units are oxyethylene, oxypropylene, and oxybutylene groups, and combinations thereof. Oxypropylene and oxybutylene groups are generally preferred. In some aspects, the oxyalkylene groups consist of only oxybutylene groups. The oxyalkylene groups can be randomly oriented or they may be present in blocks. The number of oxyalkylene units will vary and will depend on the type of oxyalkylene group, the desired physical properties of the polyetheramine (including its hydrophilicity or hydrophobicity), the nature of the polyglycerol, and other factors that are within the skilled person's discretion. In general, the average number of oxyalkylene units per hydroxyl group will be within the range of 0 to 10. In some aspects, the average number of oxyalkylene units per hydroxyl group will be within the range of 0.5 to 5 or 1 to 3.

When oxyalkylene groups are desirable, they can be introduced using different monomers and different catalytic approaches. In one preferred approach, the alkaline catalyst used to make the diglycerol or polyglycerol is used to catalyze a ring-opening addition of one or epoxide (ethylene oxide, propylene oxide, 1,2-butylene oxide, isobutylene oxide, or the like) equivalents. In some aspects, it may be desirable to use other known ring-opening polymerization catalysts, e.g., double metal cyanide catalysts, for the oxyalkylation reaction (see, e.g., U.S. Pat. Nos. 5,482,908 or 5,470,813, the teachings of which are incorporated herein by reference). In other aspects, it may by desirable to introduce the oxyalkylene units using an acidic catalyst (e.g., boron trifluoride, fluorosulfonic acid, fuming sulfuric acid, or organic clay plus an activator) to generate oxyalkylene groups from ethylene oxide, propylene oxide, butylene oxides, tetrahydrofuran, or other monomers.

In one suitable approach to making the polyetheramines, a polyglycerol starter having the structure shown below is reacted with at least four, eight, twelve, (or some other multiple of 4) molar equivalents of an epoxide, and the resulting oxyalkylated polyglycerol is aminated with ammonia and a catalyst using known procedures (see, e.g., U.S. Pat. Nos. 4,766,245; 4,912,260; 5,015,773; 5,352,835; 5,696,293; 5,817,593; and 6,376,713, the teachings of which are incorporated herein by reference):

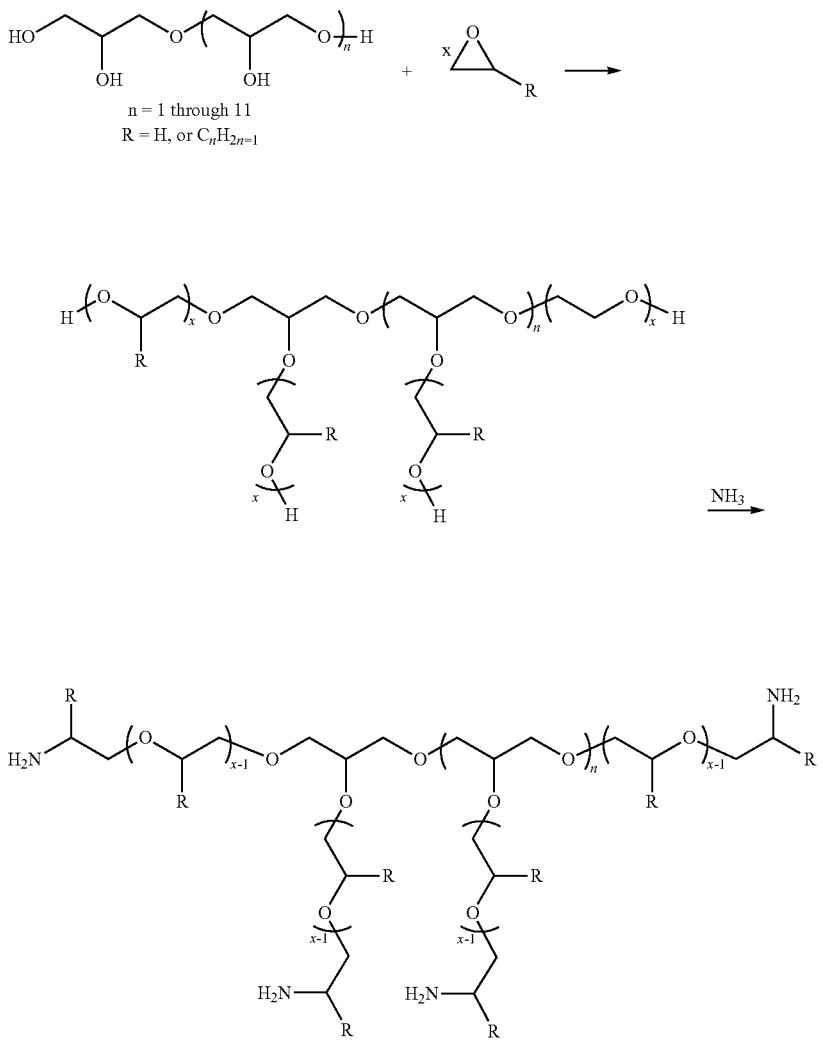

In another suitable approach, the alkoxylated polyetheramine is reacted with acrylonitrile, and the resulting cyanoethylation product is catalytically hydrogenated or is reacted with a suitable reducing agent, such as lithium aluminum hydride. The resulting polyetheramine has —$(CH_2)_3NH_2$ end groups:

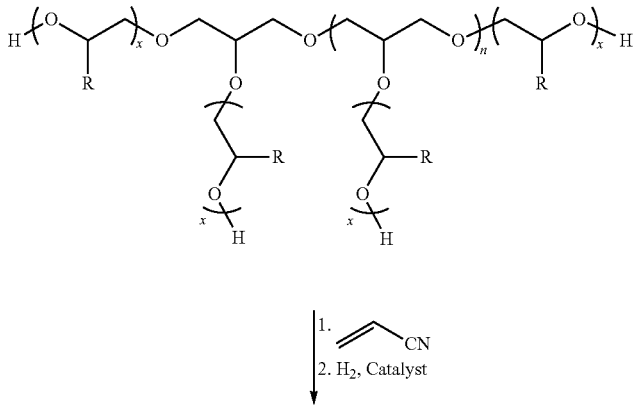

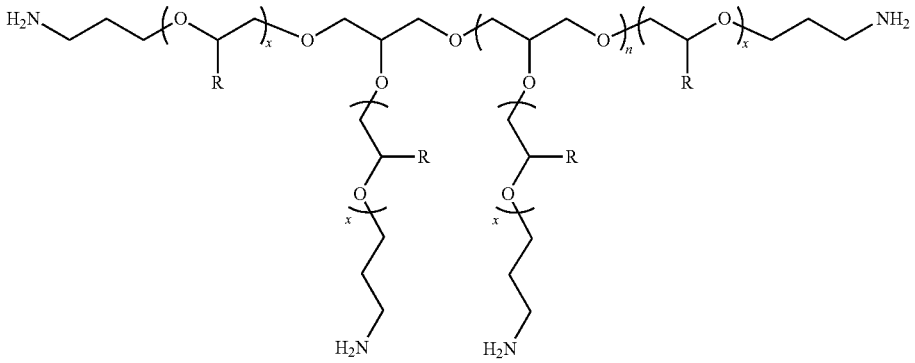

For examples of suitable cyanoethylation/hydrogenation procedures, see U.S. Pat. Nos. 5,159,101 and 5,616,811, the teachings of which are incorporated herein by reference.

Other alternative processes for making the polyetheramines utilize aziridine chemistry to introduce the amine functionality. For example, a suitable protected aziridine synthon can be produced from an aminoalcohol and di-tert-butyl dicarbonate (see B. Morinaka et al., *Org. Lett.* 9 (2007) 5219):

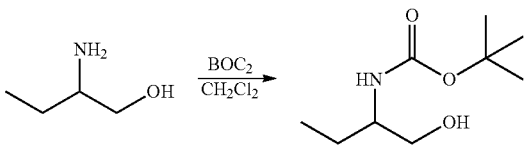

Intramolecular nucleophilic substitution of a tosylate or other suitable leaving group (as described by P. Wessig et al., *SYNLETT* (1997) 893), provides the protected aziridine:

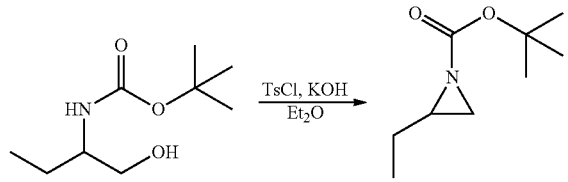

Reaction of the protected aziridine compound with a butoxylated diglycerol in the presence of a Lewis acid catalyst such as $BF_3$ etherate (see, e.g., Prasad et al. (*Tetrahedron* 58 (2002) 7355) gives the protected polyetheramine in the form of a tea-butyl carbamate:

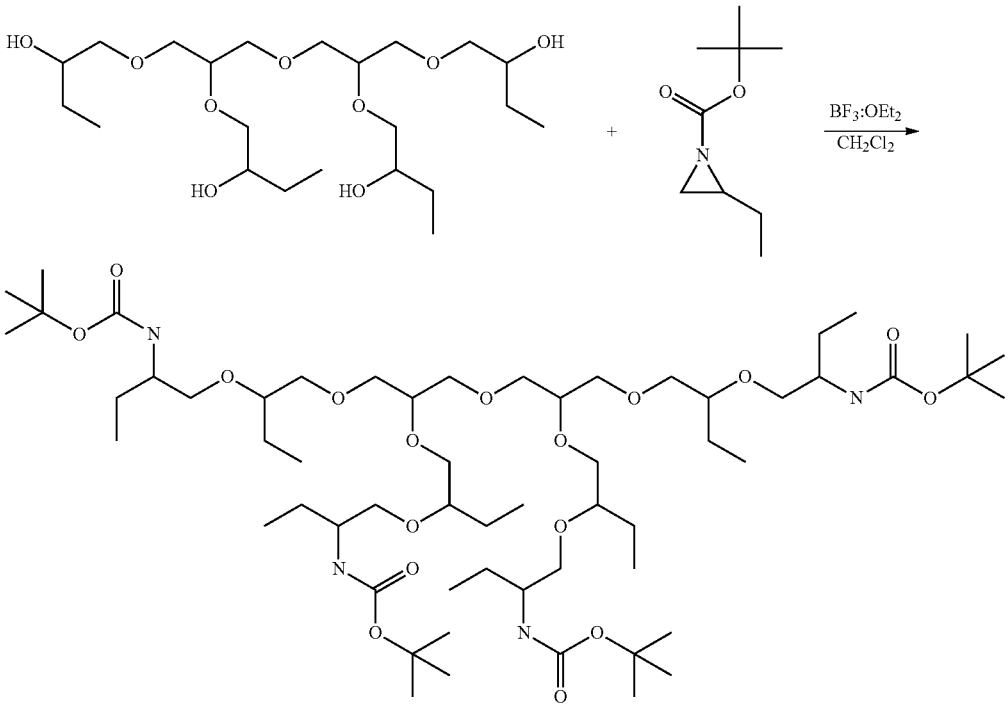
Finally, the protection is removed, for instance, by treating the carbamate-protected polyetheramine with dilute hydrochloric acid in dioxane or other solvents as described by Han et al., (*Peptide Res.* 58 (2001) 338):
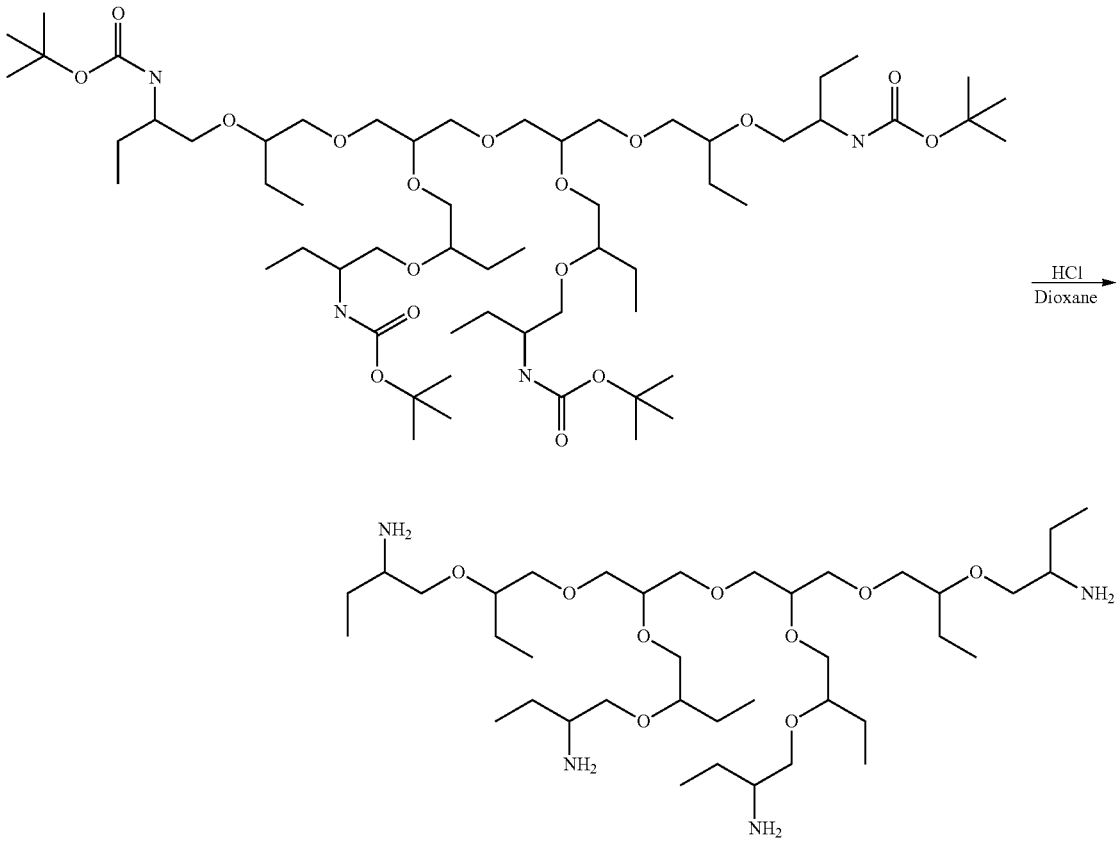

When desired, the polyetheramines can be further modified by alkylating the primary amino groups to give secondary or tertiary amines. Any of these products can be reacted with hydrogen peroxide or other oxidizing agents according to well-known methods to introduce amine oxide functionality.

In some aspects, the polyetheramine composition comprises a compound of the formula:

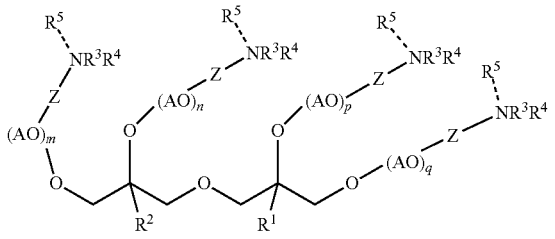

wherein each of $R^1$ and $R^2$ is independently H or $C_1$-$C_4$ alkyl; each AO is independently oxyethylene, oxypropylene, oxybutylene, or a combination thereof; each of m, n, p, and q has an average value within the range of 0 to 10; each Z is independently a linear or branched $C_2$-$C_8$ bridging group; each of $R^3$ and $R^4$ is independently H or $C_1$-$C_{10}$ alkyl; and each $R^5$ is independently an optional oxygen atom such that when $R^5$ is present, it is part of an amine oxide group. In a preferred aspect, $R^1$ and $R^2$ are hydrogen, AO is oxybutylene, each of m, n, p, and q is 1 or 2, Z is a $C_2$-$C_4$ bridging group, $R^5$ is not present, and each of $R^3$ and $R^4$ is hydrogen.

In some aspects, the polyetheramine composition comprises a compound of the formula:

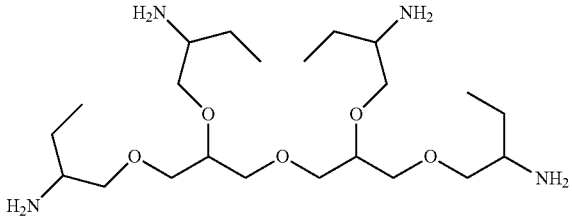

or

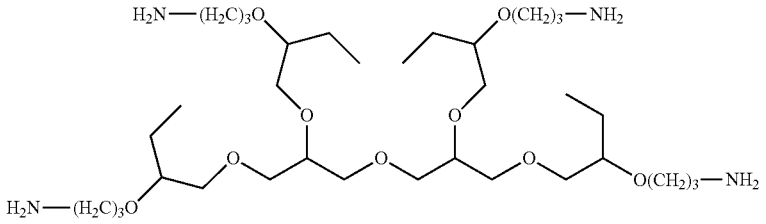

In other aspects, the polyetheramine composition comprises a compound of the formula:

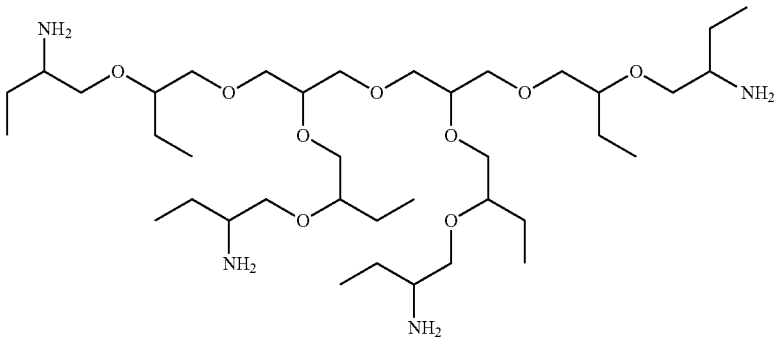

or

-continued

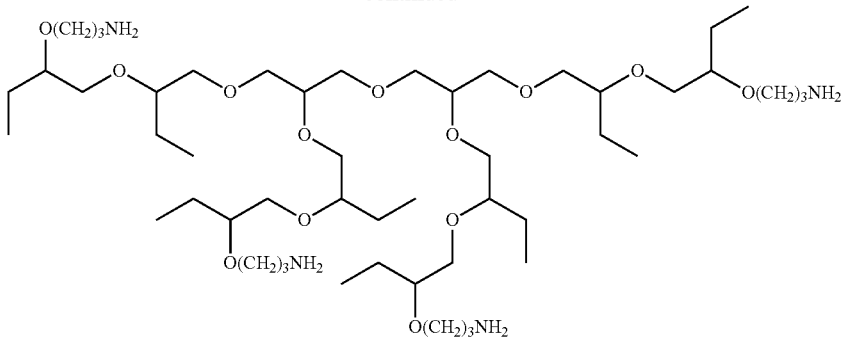

The amount of polyetheramine composition needed for a particular detergent application will depend on the nature of the polyetheramine composition, the combination of surfactant classes used, the types and amount of other components in the formulation, the nature of the surfactants, the intended end use, and other factors. Generally, however, the detergent compositions will comprise 0.2 to 10 wt. %, preferably 1 to 5 wt. %, more preferably 2 to 4 wt. % of the polyetheramine composition based on the amount of formulated polyetheramine detergent mixture, including water, the polyetheramine composition, the surfactants, and other adjuvants such as builders, pH adjustment compounds, hydrotropes, and the like.

The Surfactants

In addition to the polyetheramine composition, the inventive detergent compositions include one or more anionic, nonionic, amphoteric, zwitterionic, or cationic surfactants. Suitable surfactants in these categories are described in more detail below.

The amount of surfactant needed for a particular detergent application will depend on the nature of the polyetheramine composition, the combination of surfactant classes used, the types and amount of other components in the formulation, the nature of the surfactant, the intended end use, and other factors. Generally, however, the detergent compositions will comprise 1 to 35 wt. %, preferably 1.5 to 20 wt. %, more preferably 2 to 15 wt. % of the surfactant or mixture of surfactants based on the amount of formulated polyetheramine detergent mixture, including water, the polyetheramine composition, the surfactants, and other adjuvants such as builders, pH adjustment compounds, hydrotropes, and the like.

Anionic Surfactants

The inventive detergent compositions preferably include an anionic surfactant. "Anionic surfactants" are defined here as amphiphilic molecules with an average molecular weight of less than about 10,000, comprising one or more functional groups that exhibit a net anionic charge when present in aqueous solution at the normal wash pH, which can be a pH between 6 and 11. The anionic surfactant can be any anionic surfactant that is substantially water soluble. "Water soluble" surfactants are, unless otherwise noted, here defined to include surfactants which are soluble or dispersible to at least the extent of 0.01% by weight in distilled water at 25° C. At least one of the anionic surfactants used may be an alkali or alkaline earth metal salt of a natural or synthetic fatty acid containing between about 4 and about 30 carbon atoms. A mixture of carboxylic acid salts with one or more other anionic surfactants can also be used. Another important class of anionic compounds is the water soluble salts, particularly the alkali metal salts, of organic sulfur reaction products having in their molecular structure an alkyl radical containing from about 6 to about 24 carbon atoms and a radical selected from the group consisting of sulfonic and sulfuric acid ester radicals.

Specific types of anionic surfactants are identified in the following paragraphs.

Carboxylic acid salts are represented by the formula:

$$R^1COOM$$

where $R^1$ is a primary or secondary alkyl group of 4 to 30 carbon atoms and M is a solubilizing cation. The alkyl group represented by $R^1$ may represent a mixture of chain lengths and may be saturated or unsaturated, although it is preferred that at least two thirds of the $R^1$ groups have a chain length of between 8 and 18 carbon atoms. Non-limiting examples of suitable alkyl group sources include the fatty acids derived from coconut oil, tallow, tall oil and palm kernel oil. For the purposes of minimizing odor, however, it is often desirable to use primarily saturated carboxylic acids. Such materials are well known to those skilled in the art, and are available from many commercial sources, such as Uniqema (Wilmington, Del.) and Twin Rivers Technologies (Quincy, Mass.). The solubilizing cation, M, may be any cation that confers water solubility to the product, although monovalent such moieties are generally preferred. Examples of acceptable solubilizing cations for use with the present technology include alkali metals such as sodium and potassium, which are particularly preferred, and amines such as triethanolammonium, ammonium and morpholinium. Although, when used, the majority of the fatty acid should be incorporated into the formulation in neutralized salt form, it is often preferable to leave a small amount of free fatty acid in the formulation, as this can aid in the maintenance of product viscosity.

Primary alkyl sulfates are represented by the formula:

$$R^2OSO_3M$$

where $R^2$ is a primary alkyl group of 8 to 18 carbon atoms and can be branched or linear, saturated or unsaturated. M is H or a cation, e.g., an alkali metal cation (e.g., sodium, potassium, lithium), or ammonium or substituted ammonium (e.g., methyl-, dimethyl-, and trimethylammonium cations and quaternary ammonium cations such as tetramethylammonium and dimethylpiperidinium cations and quaternary ammonium cations derived from alkylamines such as ethylamine, diethylamine, triethylamine, and mixtures thereof, and the like). The alkyl group $R^2$ may have a mixture of chain lengths. It is preferred that at least two-thirds of the $R^2$ alkyl groups have a chain length of 8 to 18 carbon atoms. This will be the case if $R^2$ is coconut alkyl, for example. The solubilizing cation may be a range of cations which are in general monovalent and confer water solubility. An alkali metal, notably sodium, is especially envisaged. Other possibilities are ammonium and substituted ammonium ions, such as trialkanolammonium or trialkylammonium.

Alkyl ether sulfates are represented by the formula:

$$R^3O(CH_2CH_2O)_nSO_3M$$

where $R^3$ is a primary alkyl group of 8 to 18 carbon atoms, branched or linear, saturated or unsaturated, and n has an average value in the range from 1 to 6 and M is a solubilizing cation. The alkyl group $R^3$ may have a mixture of chain lengths. It is preferred that at least two-thirds of the $R^3$ alkyl groups have a chain length of 8 to 18 carbon atoms. This will be the case if $R^3$ is coconut alkyl, for example. Preferably n has an average value of 2 to 5. Ether sulfates have been found to provide viscosity build in certain of the formulations of the present technology, and thus are considered a preferred ingredient.

Other suitable anionic surfactants that can be used are alkyl ester sulfonate surfactants including linear esters of $C_8$-$C_{20}$ carboxylic acids (i.e., fatty acids) which are sulfonated with gaseous $SO_3$ (see, e.g., *J. Am. Oil Chem. Soc.* 52 (1975) 323). Suitable starting materials would include natural fatty substances as derived from tallow, palm oil, and the like.

Preferred alkyl ester sulfonate surfactants, especially for laundry applications, comprise alkyl ester sulfonate surfactants of the structural formula:

$$R^3—CH(SO_3M)\text{-}C(O)—OR^4$$

where $R^3$ is a $C_6$-$C_{20}$ hydrocarbyl, preferably an alkyl or combination thereof $R^4$ is a $C_1$-$C_6$ hydrocarbyl, preferably an alkyl, or combination thereof, and M is a cation that forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. The group $R^3$ may have a mixture of chain lengths. Preferably at least two-thirds of these groups have 6 to 12 carbon atoms. This will be the case when the moiety $R^3CH(—)CO_2(—)$ is derived from a coconut source, for instance. Preferably, $R^3$ is $C_{10}$-$C_{16}$ alkyl, and $R^4$ is methyl, ethyl or isopropyl. Especially preferred are the methyl ester sulfonates where $R^3$ is $C_{10}$-$C_{16}$ alkyl.

Paraffin sulfonates having about 8 to about 22 carbon atoms, preferably about 12 to about 16 carbon atoms, in the alkyl moiety, are contemplated for use here. They are usually produced by the sulfoxidation of petrochemically derived normal paraffins. These surfactants are commercially available as, for example, Hostapur SAS from Clariant (Charlotte, N.C.).

Olefin sulfonates having 8 to 22 carbon atoms, preferably 12 to 16 carbon atoms, are also contemplated for use in the present compositions. The olefin sulfonates are further characterized as having from 0 to 1 ethylenic double bonds; from 1 to 2 sulfonate moieties, of which one is a terminal group and the other is not; and 0 to 1 secondary hydroxyl moieties. U.S. Pat. No. 3,332,880 contains a description of suitable olefin sulfonates, and its teachings are incorporated herein by reference. Such materials are sold as, for example, Bio-Terge® AS-40, a product of Stepan.

Organic phosphate-based anionic surfactants include organic phosphate esters such as complex mono- or diester phosphates of hydroxyl-terminated alkoxide condensates, or salts thereof. Suitable organic phosphate esters include phosphate esters of polyoxyalkylated alkylaryl phenols, phosphate esters of ethoxylated linear alcohols, and phosphate esters of ethoxylated phenols. Also included are nonionic alkoxylates having a sodium alkylenecarboxylate moiety linked to a terminal hydroxyl group of the nonionic through an ether bond. Counterions to the salts of all the foregoing may be those of alkali metal, alkaline earth metal, ammonium, alkanolammonium and alkylammonium types.

Other anionic surfactants useful for detersive purposes can also be included in the detergent compositions. These can include salts (including, for example, sodium, potassium, ammonium, and substituted ammonium salts such as mono-, di- and triethanolamine salts) of soap, $C_8$-$C_{22}$ primary of secondary alkanesulfonates, $C_8$-$C_{24}$ olefin sulfonates, sulfonated polycarboxylic acids prepared by sulfonation of the pyrolyzed product of alkaline earth metal citrates, e.g., as described in British Pat. No. 1,082,179, $C_8$-$C_{24}$ alkyl poly glycol ether sulfates (containing up to 10 moles of ethylene oxide); alkyl glycerol sulfonates, fatty acyl glycerol sulfonates, fatty oleoyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$-$C_{18}$ monoesters) and diesters of sulfosuccinates (especially saturated and unsaturated $C_6$-$C_{12}$ diesters), sulfates of alkylpolysaccharides such as the sulfates of alkylpolyglucoside (the nonionic non-sulfated compounds being described below), and alkyl polyethoxy carboxylates such as those of the formula $RO(CH_2CH_2O)_kCH_2COO\text{-}M+$ where R is a $C_8$-$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are described in "Surface Active Agents and Detergents" (Vol. I and II by Schwartz, Perry and Berch). A variety of such surfactants are also generally disclosed in U.S. Pat. Nos. 3,929,678 and 6,949,498, the teachings of which are incorporated herein by reference.

Other anionic surfactants contemplated include isethionates, sulfated triglycerides, alcohol sulfates, ligninsulfonates, naphthelene sulfonates and alkyl naphthelene sulfonates, and the like.

For a more general description of suitable anionic surfactants, see U.S. Pat. No. 5,929,022, the teachings of which are incorporated herein by reference.

Preferred anionic surfactants are selected from the group consisting of linear alkylbenzene sulfonates, fatty alcohol sulfates, fatty alcohol ether sulfates, and mixtures thereof.

Nonionic or Amphoteric Surfactants

Examples of suitable nonionic surfactants include alkyl polyglucosides ("APGs"), alcohol ethoxylates, nonylphenol ethoxylates, methyl ester ethoxylates ("MEEs"), and others. The nonionic surfactant may be used as from 1% to 90%, more preferably from 1 to 40% and most preferably between 1% and 32% of a detergent composition. Other suitable nonionic surfactants are described in U.S. Pat. No. 5,929,022, from which much of the following discussion comes.

One class of nonionic surfactants useful herein are condensates of ethylene oxide with a hydrophobic moiety to provide a surfactant having an average hydrophilic-lipophilic balance (HLB) in the range from 8 to 17, preferably from 9.5 to 14, more preferably from 12 to 14. The hydrophobic (lipophilic) moiety may be aliphatic or aromatic and the length of the polyoxyethylene group which is condensed with any particular hydrophobic group can be readily adjusted to yield a water-soluble compound having the desired degree of balance between hydrophilic and hydrophobic elements.

For "low HLB" nonionics, low HLB can be defined as having an HLB of 8 or less and preferably 6 or less. A "low level" of co-surfactant can be defined as 6% or less of the HDL and preferably 4% or less of the HDL.

Especially preferred nonionic surfactants of this type are the $C_9$-$C_{15}$ primary alcohol ethoxylates containing 3-12 moles of ethylene oxide per mole of alcohol, particularly the $C_{12}$-$C_{15}$ primary alcohols containing 5-8 moles of ethylene oxide per mole of alcohol. One suitable example of such a surfactant is polyalkoxylated aliphatic base, sold for example as Bio-Soft® N25-7 by Stepan Company.

Another class of nonionic surfactants comprises alkyl polyglucoside compounds of general formula:

$$RO—(C_nH_{2n}O)_tZ_x$$

where Z is a moiety derived from glucose; R is a saturated hydrophobic alkyl group that contains from 12 to 18 carbon atoms; t is from 0 to 10 and n is 2 or 3; x has an average value from 1.3 to 4. The compounds include less than 10% unreacted fatty alcohol and less than 50% short chain alkyl polyglucosides. Compounds of this type and their use in detergent compositions are disclosed in EP-B 0 070 077, EP 0 075 996 and EP 0 094 118.

Also suitable as nonionic surfactants are polyhydroxy fatty acid amide surfactants of the formula:

$$R^2—C(O)—N(R^1)—Z$$

where $R^1$ is H, or $R^1$ is $C_{1-4}$ hydrocarbyl, 2-hydroxyethyl, 2-hydroxypropyl or a mixture thereof, $R^2$ is $C_5$-$C_{31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

Preferably, the nonionic surfactant is selected from the group consisting of fatty alcohol ethoxylates and alkyl polyglucosides.

Ampholytic synthetic detergents can be broadly described as derivatives of aliphatic or aliphatic derivatives of heterocyclic secondary and tertiary amines, in which the aliphatic radical may be straight chain or branched and where one of the aliphatic substituents contains from about 8 to about 18 carbon atoms and at least one contains an anionic water-solubilizing group, e.g., carboxy, sulfo, sulfato, phosphato, or phosphono (see U.S. Pat. Nos. 3,664,961 and 3,929,678, the teachings of which are incorporated herein by reference). Suitable ampholytic surfactants include fatty amine oxides, fatty amidopropylamine oxides, fatty betaines, and fatty amidopropylamine betaines. Examples of suitable betaines are coco betaine (CB) and cocoamidopropyl betaine (CAPB). Commercially available betaines include Amphosol® HCG or Amphosol® HCA (cocamidopropyl betaine) surfactants (Stepan). Suitable amine oxides include laurylamine oxide, myristylamine oxide, lauryl amidopropylamine oxide, myristyl amidopropylamine oxide, and the like, and mixtures thereof. Commercially available amine oxides include Ammonyx® LO, Ammonyx® MO, and Ammonyx® LMDO surfactants (Stepan).

Ampholytic surfactants can be used at a level from 1% to 50%, more preferably from 1% to 10%, even more preferably between 1% and 5% of the formulation, by weight.

Amine oxide surfactants are suitable ampholytic surfactants. Compositions herein may comprise an amine oxide in accordance with the general formula:

$$R^1(EO)_x(PO)_y(BO)_zN(O)(CH_2R')_2.H_2O$$

In general, it can be seen that the preceding formula provides one long-chain moiety $R^1(EO)_x(PO)_y(BO)_z$ and two short chain moieties, —$CH_2R'$. R' is preferably selected from hydrogen, methyl and —$CH_2OH$. In general $R^1$ is a primary or branched hydrocarbyl moiety which can be saturated or unsaturated, preferably, $R^1$ is a primary alkyl moiety. When x+y+z=0, $R^1$ is a hydrocarbyl moiety having a chain length of from about 8 to about 18. When x+y+z is different from 0, $R^1$ may be somewhat longer, having a chain length in the range $C_{12}$-$C_{24}$. The general formula also encompasses amine oxides where x+y+z=0, $R^1$ is $C_8$-$C_{18}$, R' is H and q=from 0 to 2, preferably 2. These amine oxides are illustrated by $C_{12-14}$ alkyldimethyl amine oxide, hexadecyl dimethylamine oxide, octadecylamine oxide and their hydrates, especially the dihydrates as disclosed in U.S. Pat. Nos. 5,075,501 and 5,071,594, the teachings of which are incorporated herein by reference.

Also suitable are amine oxides where x+y+z is different from zero. Specifically, x+y+z is from about 1 to about 10, and $R^1$ is a primary alkyl group containing about 8 to about 24 carbons, preferably from about 12 to about 16 carbon atoms. In these embodiments y+z is preferably 0 and x is preferably from about 1 to about 6, more preferably from about 2 to about 4; EO represents ethyleneoxy; PO represents propyleneoxy; and BO represents butyleneoxy. Such amine oxides can be prepared by conventional synthetic methods, e.g., by the reaction of alkylethoxysulfates with dimethylamine followed by oxidation of the ethoxylated amine with hydrogen peroxide.

Preferred amine oxides are solids at ambient temperature. More preferably, they have melting points in the range of 30° C. to 90° C. Amine oxides suitable for use are made commercially by Stepan, AkzoNobel, Procter & Gamble, and others. See McCutcheon's compilation and a Kirk-Othmer review article for alternate amine oxide manufacturers.

Suitable detergents may include, e.g., hexadecyldimethylamine oxide dihydrate, octadecyldimethylamine oxide dihydrate, hexadecyltris(ethyleneoxy)dimethylamine oxide, and tetradecyldimethylamine oxide dihydrate.

In certain aspects in which R' is H, there is some latitude with respect to having R' slightly larger than H. Specifically, R' may be $CH_2OH$, as in hexadecylbis(2-hydroxyethyl) amine oxide, tallowbis(2-hydroxyethyl)amine oxide, stearylbis(2-hydroxyethyl)amine oxide and oleylbis(2-hydroxyethyl)amine oxide.

Zwitterionic Surfactants

Zwitterionic synthetic detergents can be broadly described as derivatives of aliphatic quaternary ammonium and phosphonium or tertiary sulfonium compounds, in which the cationic atom may be part of a heterocyclic ring, and in which the aliphatic radical may be straight chain or branched, and where one of the aliphatic substituents contains from about 3 to 18 carbon atoms, and at least one aliphatic substituent contains an anionic water-solubilizing group, e.g., carboxy, sulfo, sulfato, phosphato, or phosphono (see U.S. Pat. No. 3,664,961, the teachings of which are incorporated herein by reference). Zwitterionic surfactants can be used as from 1% to 50%, more preferably from 1% to 10%, even more preferably from 1% to 5% by weight of the present formulations.

Cationic Surfactants

Specific cationic surfactants contemplated for use in the present compositions include ditallow dimethylammonium chloride (DTDMAC), fatty alkanolamides (FAA), and quaternized diesters of trialkanolamines and fatty acids. The proportions of cationic surfactants used in a formulation can range, for example, from 0.1% to 20%, more preferably between 1% and 10%, even more preferably between 1% and 5%. (See also U.S. Pat. No. 5,929,022, from which much of the following discussion comes.)

Cationic detersive surfactants suitable for use in the inventive detergent compositions include those having one long-chain hydrocarbyl group. Examples of such cationic surfactants include the ammonium surfactants such as alkyldimethylammonium halogenides, and those surfactants having the formula:

$$[R^2(OR^3)_y][R^4(OR^3)_y]_2R^5N^+X^-$$

where $R^2$ is an alkyl or alkyl benzyl group having from about 8 to about 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$-$C_4$ alkyl, $C_1$-$C_4$ hydroxyalkyl, benzyl ring structures formed by joining the two $R^4$ groups, —$CH_2CHOH$—$CH(OH)C(O)R^6CH(OH)CH_2OH$ where $R^6$ is any hexose or hexose polymer having a molecular weight less than about 1000, and hydrogen when y is not 0; $R^5$ is the same as $R^4$ or is an alkyl chain where the total number of carbon atoms of $R^2$ plus $R^5$ is not more than about 18; each y is from 0 to about 10 and the sum of the y values is from 0 to about 15; and X is any compatible anion. The long-chain cationic surfactant can also be the quaternized version of stearamidopropyl dimethylamine (e.g., stearamidopropyl trimethylamine chloride).

Preferred cationic surfactants are the water-soluble quaternary ammonium compounds having the formula:

$$R^1R^2R^3R^4N^+X^-$$

where $R^1$ is $C_8$-$C_{16}$ alkyl, each of $R^2$, $R^3$ and $R^4$ is independently $C_1$-$C_4$ alkyl, $C_1$-$C_4$ hydroxyalkyl, benzyl, or —$(C_2H_4O)_x$ H where x has a value from 1 to 5, and X is an anion. In one aspect, not more than one of $R^2$, $R^3$ or $R^4$ is benzyl.

The preferred alkyl chain length for $R^1$ is $C_{12}$-$C_{15}$, particularly where the alkyl group is a mixture of chain lengths derived from coconut or palm kernel fat or is derived synthetically by olefin build up or oxo alcohols synthesis. Preferred groups for $R^2$, $R^3$, and $R^4$ are methyl and hydroxyethyl groups and the anion X may be selected from halide, methosulfate, acetate and phosphate ions.

Examples of suitable quaternary ammonium compounds for use here are:

hexadecyl trimethyl ammonium chloride, also known as cetrimonium chloride, sold commercially as Ammonyx® Cetac by Stepan Co.;

coconut trimethyl ammonium chloride or bromide;

coconut methyl dihydroxyethyl ammonium chloride or bromide;

decyl triethyl ammonium chloride;

decyl dimethyl hydroxyethyl ammonium chloride or bromide;

$C_{12-15}$ dimethyl hydroxyethyl ammonium chloride or bromide;

coconut dimethyl hydroxyethyl ammonium chloride or bromide;

myristyl trimethyl ammonium methyl sulfate;

lauryl dimethyl benzyl ammonium chloride or bromide;

lauryl dimethyl (ethenoxy)4 ammonium chloride or bromide;

choline esters of formula $$R^1R^2R^3R^4N^+X^-$$

where $R^1$ is —$CH_2$—O—C(O)—($C_{12-14}$ alkyl) and $R^2$, $R^3$, and $R^4$ are methyl; and combinations of these.

Other cationic surfactants useful here are also described in U.S. Pat. No. 4,228,044, the teachings of which are incorporated herein by reference.

Mixtures of any two or more individually contemplated surfactants, whether of the same type or different types, are contemplated herein.

General Considerations for Laundry Detergents

Desirable surfactant attributes for laundry detergents include having the ability to be formulated as heavy duty liquid (HDL) detergents, powders, bar soaps, sachets, pods, or other detergents forms.

For HDLs, this includes being in liquid form at room temperature, an ability to be formulated in cold-mix applications, and an ability to perform as well as or better than existing surfactants.

Desirable attributes for HDLs include, for example, the ability to emulsify, suspend or penetrate greasy or oily soils and suspend or disperse particulates, in order to clean surfaces; and then prevent the soils, grease, or particulates from re-depositing on the newly cleaned surfaces.

It is also desirable to have the ability to control the foaming. For use of an HDL in a high-efficiency washing machine, low foam is desired to achieve the best cleaning and to avoid excess foaming. Other desirable properties include the ability to clarify the formulation and to improve long-term storage stability under both extreme outdoor and normal indoor temperatures.

The skilled person will appreciate that the inventive detergent compositions as described above may not be mere "drop-in" substitutions in an existing detergent formulation. Some amount of re-formulation is typically necessary to adjust the nature and amounts of other surfactants, hydrotropes, alkalinity control agents, and/or other components of the formulation in order to achieve a desirable outcome in terms of appearance, handling, solubility characteristics, and other physical properties and performance attributes. For example, a formulation might need to be adjusted by using, in combination with the inventive detergent compositions, a more highly ethoxylated nonionic surfactant instead of one that has fewer EO units. This kind of reformulating is considered to be within ordinary skill and is left to the skilled person's discretion.

A wide variety of detergent compositions can be made that include the inventive detergent compositions, with or without other ingredients as specified below. Formulations are contemplated including 1% to 99% of the inventive detergent compositions, more preferably between 1% and 60%, even more preferably between 1% and 30%, with 99% to 1% water and, optionally, other ingredients as described here.

Formulation and Use

Four desirable characteristics of a laundry detergent composition, in particular a liquid composition (although the present disclosure is not limited to a liquid composition, or to a composition having any or all of these attributes) are that (1) a concentrated formulation is useful to save on shelf space of a retailer, (2) a "green" or environmentally friendly composition is useful, (3) a composition that works in modern high efficiency washing machines which use less energy and less water to wash clothes than previous machines is useful, and (4) a composition that cleans well in cold water, i.e., less than 30° C., preferably 5° C. to 30° C.

To save a substantial amount of retailer shelf space, a concentrated formulation is contemplated having two or even three, four, five, six, or even greater (e.g., 8×) times potency per unit volume or dose as conventional laundry detergents. The use of less water complicates the formulation of a detergent composition, as it needs to be more soluble and otherwise to work well when diluted in relatively little water.

To make a "green" formula, the surfactants should be ultimately biodegradable and non-toxic. To meet consumer perceptions and reduce the use of petrochemicals, a "green" formula may also advantageously be limited to the use of renewable hydrocarbons, such as vegetable or animal fats and oils, in the manufacture of surfactants.

High efficiency (HE) washing machines present several challenges to the detergent formulation. As of January 2011, all washing machines sold in the U.S. must be HE, at least to some extent, and this requirement will only become more restrictive in the coming years. Front loading machines, all of which are HE machines, represent the highest efficiency, and are increasingly being used.

Heavy duty liquid detergent formulas are impacted by HE machines because the significantly lower water usage requires that less foam be generated during the wash cycle. As the water usage levels continue to decrease in future generations of HE machines, detergents may be required to transition to no foam. In addition, HE HDLs should also disperse quickly and cleanly at lower wash temperatures.

To work in a modern high efficiency washing machine, the detergent composition needs to work in relatively concentrated form in cold water, as these washing machines use relatively little water and cooler washing temperatures than prior machines. The sudsing of such high-efficiency formulations must also be reduced, or even eliminated, in a low-water environment to provide effective cleaning performance. The anti-redeposition properties of a high efficiency detergent formulation also must be robust in a low-water environment. In addition, formulations that allow the used wash water to be more easily rinsed out of the clothes or spun out of the clothes in a washing machine are also contemplated, to promote efficiency.

Liquid fabric softener formulations and "softergent" (fabric softener/detergent dual functional) single-add formulations also may need to change as water usage continues to decline in HE machines. A washer-added softener is dispensed during the rinse cycle in these machines. The inventive detergent compositions can be used in formulations that provide softening in addition to cleaning.

Laundry detergents and additives containing the presently described inventive detergent compositions are contemplated to provide high concentration formulations, or "green" formulations, or formulations that work well in high efficiency washing machines. Such detergents and additives are contemplated that have at least one of the advantages or desirable characteristics specified above, or combinations of two or more of these advantages, at least to some degree. The ingredients contemplated for use in such laundry detergents and additives are found in the following paragraphs.

In addition to the surfactants as previously described, a laundry detergent composition commonly contains other ingredients for various purposes. Some of those ingredients are also described below.

Builders and Alkaline Agents

Builders and other alkaline agents are contemplated for use in the present formulations.

Any conventional builder system is suitable for use here, including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for environmental reasons, phosphate builders could also be used here.

Suitable polycarboxylate builders for use here include citric acid, preferably in the form of a water-soluble salt, and derivatives of succinic acid of the formula:

$$R—CH(COOH)CH_2(COOH)$$

where R is $C_{10-20}$ alkyl or alkenyl, preferably $C_{12}$-$C_{16}$, or where R can be substituted with hydroxyl, sulfo, sulfoxyl, or sulfone substituents. Specific examples include lauryl succinate, myristyl succinate, palmityl succinate, 2-dodecenylsuccinate, or 2-tetradecenyl succinate. Succinate builders are preferably used in the form of their water-soluble salts, including sodium, potassium, ammonium, and alkanolammonium salts.

Other suitable polycarboxylates are oxodisuccinates and mixtures of tartrate monosuccinic and tartrate disuccinic acid, as described in U.S. Pat. No. 4,663,071.

Especially for a liquid detergent composition, suitable fatty acid builders for use here are saturated or unsaturated $C_{10}$-$C_{-18}$ fatty acids, as well as the corresponding soaps. Preferred saturated species have from 12 to 16 carbon atoms in the alkyl chain. The preferred unsaturated fatty acid is oleic acid. Another preferred builder system for liquid compositions is based on dodecenyl succinic acid and citric acid.

Some examples of alkaline agents include alkali metal (Na, K, or $NH_4$) hydroxides, carbonates, citrates, and bicarbonates. Another commonly used builder is borax.

For powdered detergent compositions, the builder or alkaline agent typically comprises from 1% to 95% of the composition. For liquid compositions, the builder or alkaline agent typically comprises from 1% to 60%, alternatively between 1% and 30%, alternatively between 2% and 15%. See U.S. Pat. No. 5,929,022, the teachings of which are incorporated by reference, from which much of the preceding discussion comes. Other builders are described in PCT Int. Publ. WO 99/05242, which is incorporated here by reference.

Enzymes

The detergent compositions may further comprise one or more enzymes, which provide cleaning performance and/or fabric care benefits. The enzymes include cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, beta-glucanases, arabinosidases or mixtures thereof.

A preferred combination is a detergent composition having a cocktail of conventional applicable enzymes like protease, amylase, lipase, cutinase and/or cellulase in conjunction with the lipolytic enzyme variant D96L at a level of from 50 LU to 8500 LU per liter of wash solution.

Suitable cellulases include both bacterial or fungal cellulase. Preferably, they will have a pH optimum of between 5 and 9.5. Suitable cellulases are disclosed in U.S. Pat. No. 4,435,307, which discloses fungal cellulase produced from

*Humicola insolens*. Suitable cellulases are also disclosed in GB-A-2 075 028; GB-A-2 095 275 and DE-OS-2 247 832.

Examples of such cellulases are cellulases produced by a strain of *Humicola insolens* (*Humicola grisea* var. *thermoidea*), particularly the *Humicola* strain DSM 1800. Other suitable cellulases are cellulases originated from *Humicola insolens* having a molecular weight of about 50,000, an isoelectric point of 5.5 and containing 415 amino acid units. Especially suitable cellulases are the cellulases having color care benefits. Examples of such cellulases are cellulases described in EP Appl. No. 91202879.2.

Peroxidase enzymes are used in combination with oxygen sources, e.g. percarbonate, perborate, persulfate, hydrogen peroxide, and the like. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase, and haloperoxidases such as chloro- and bromoperoxidase. Peroxidase-containing detergent compositions are disclosed, for example, in PCT Int. Appl. WO 89/099813 and in EP Appl. No. 91202882.6.

The cellulases and/or peroxidases are normally incorporated in the detergent composition at levels from 0.0001% to 2% of active enzyme by weight of the detergent composition.

Preferred commercially available protease enzymes include those sold under the tradenames Alcalase®, Savinase®, Primase®, Durazym®, and Esperase® by Novo Nordisk A/S (Denmark), those sold under the tradename Maxatase®, Maxacal® and Maxapem® by Gist-Brocades, those sold by Genencor International, and those sold under the tradename Opticlean® and Optimase® by Solvay Enzymes. Other proteases are described in U.S. Pat. No. 5,679,630 can be included in the detergent compositions. Protease enzyme may be incorporated into the detergent compositions at a level of from about 0.0001% to about 2% active enzyme by weight of the composition.

A preferred protease here referred to as "Protease D" is a carbonyl hydrolase variant having an amino acid sequence not found in nature, which is derived from a precursor carbonyl hydrolase by substituting a different amino acid for the amino acid residue at a position in the carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in U.S. Pat. No. 5,679,630, the teachings of which are incorporated herein by reference.

Highly preferred enzymes that can be included in the detergent compositions include lipases. It has been found that the cleaning performance on greasy soils is synergistically improved by using lipases. Suitable lipase enzymes include those produced by microorganisms of the *Pseudomonas* group, such as *Pseudomonas stutzeri* ATCC 19.154, as disclosed in British Pat. No. 1,372,034. Suitable lipases include those which show a positive immunological cross-reaction with the antibody of the lipase, produced by the microorganism *Pseudomonas fluorescens* IAM 1057. This lipase is available from Amano Pharmaceutical Co. Ltd., Nagoya, Japan, under the trade name Lipase P "Amano," hereafter referred to as "Amano-P." Further suitable lipases are lipases such as M1 Lipase® and Lipomax® (Gist-Brocades). Highly preferred lipases are the D96L lipolytic enzyme variant of the native lipase derived from *Humicola lanuginosa* as described in U.S. Pat. No. 6,017,871. Preferably, the *Humicola lanuginosa* strain DSM 4106 is used. This enzyme is incorporated into the detergent compositions at a level of from 50 LU to 8500 LU per liter wash solution. Preferably, the variant D96L is present at a level of from 100 LU to 7500 LU per liter of wash solution. A more preferred level is from 150 LU to 5000 LU per liter of wash solution.

By "D96L lipolytic enzyme variant," we mean the lipase variant as described in PCT Int. Appl. WO 92/05249, where the native lipase ex *Humicola lanuginosa* aspartic acid (D) residue at position 96 is changed to leucine (L). According to this nomenclature, the substitution of aspartic acid to leucine in position 96 is shown as: D96L.

Also suitable are cutinases [EC 3.1.1.50] which can be considered as a special kind of lipase, namely lipases that do not require interfacial activation. Addition of cutinases to detergent compositions is described, e.g. in PCT Int. Appl. No. WO 88/09367.

The lipases and/or cutinases are normally incorporated in the detergent composition at levels from 0.0001% to 2% of active enzyme by weight of the detergent composition.

Amylases ($\alpha$ and/or $\beta$) can be included for removal of carbohydrate-based stains. Suitable amylases are Termamyl® (Novo Nordisk), Fungamyl® and BAN® amylases (Novo Nordisk).

The above-mentioned enzymes may be of any suitable origin, such as vegetable, animal, bacterial, fungal and/or yeast origin. See U.S. Pat. No. 5,929,022, the teachings of which are incorporated herein by reference, from which much of the preceding discussion comes. Preferred compositions optionally contain a combination of enzymes or a single enzyme, with the amount of each enzyme commonly ranging from 0.0001% to 2%.

Other enzymes and materials used with enzymes are described in PCT Int. Appl. No. WO99/05242, which is incorporated here by reference.

Adjuvants

The detergent compositions optionally contain one or more soil suspending agents or resoiling inhibitors in an amount from about 0.01% to about 5% by weight, alternatively less than about 2% by weight. Resoiling inhibitors include anti-redeposition agents, soil release agents, or combinations thereof. Suitable agents are described in U.S. Pat. No. 5,929,022, and include water-soluble ethoxylated amines having clay soil removal and anti-redeposition properties. Examples of such soil release and anti-redeposition agents include an ethoxylated tetraethylenepentamine. Further suitable ethoxylated amines are described in U.S. Pat. No. 4,597,898, the teachings of which are incorporated herein by reference. Another group of preferred clay soil removal/anti-redeposition agents are the cationic compounds disclosed in EP Appl. No. 111,965. Other clay soil removal/anti-redeposition agents which can be used include the ethoxylated amine polymers disclosed in EP Appl. No. 111,984; the zwitterionic polymers disclosed in EP Appl. No. 112,592; and the amine oxides disclosed in U.S. Pat. No. 4,548,744, the teachings of which are incorporated herein by reference.

Other clay soil removal and/or anti-redeposition agents known in the art can also be utilized in the compositions hereof. Another type of preferred anti-redeposition agent includes the carboxymethylcellulose (CMC) materials.

Anti-redeposition polymers can be incorporated into HDL formulations described herein. It may be preferred to keep the level of anti-redeposition polymer below about 2%. At levels above about 2%, the anti-redeposition polymer may cause formulation instability (e.g., phase separation) and or undue thickening.

Soil release agents are also contemplated as optional ingredients in the amount of about 0.1% to about 5% (see, e.g., U.S. Pat. No. 5,929,022).

Chelating agents in the amounts of about 0.1% to about 10%, more preferably about 0.5% to about 5%, and even more preferably from about 0.8% to about 3%, are also contemplated as an optional ingredient (see, e.g., U.S. Pat. No. 5,929,022).

Polymeric dispersing agents in the amount of 0% to about 6% are also contemplated as an optional component of the presently described detergent compositions (see, e.g., U.S. Pat. No. 5,929,022).

A suds suppressor is also contemplated as an optional component of the present detergent composition, in the amount of from about 0.1% to about 15%, more preferably between about 0.5% to about 10% and even more preferably between about 1% to about 7% (see, e.g., U.S. Pat. No. 5,929,022).

Other ingredients that can be included in a liquid laundry detergent include perfumes, which optionally contain ingredients such as aldehydes, ketones, esters, and alcohols. More compositions that can be included are: carriers, hydrotropes, processing aids, dyes, pigments, solvents, bleaches, bleach activators, fluorescent optical brighteners, and enzyme stabilizing packaging systems.

Other common cleaning adjuncts are identified in U.S. Pat. No. 7,326,675 and PCT Int. Publ. WO 99/05242. Such cleaning adjuncts are identified as including bleaches, bleach activators, suds boosters, dispersant polymers (e.g., from BASF Corp. or Dow Chemical) other than those described above, color speckles, silvercare, anti-tarnish and/or anti-corrosion agents, pigments, dyes, fillers, germicides, hydrotropes, anti-oxidants, enzyme stabilizing agents, pro-perfumes, carriers, processing aids, solvents, dye transfer inhibiting agents, brighteners, structure elasticizing agents, fabric softeners, anti-abrasion agents, and other fabric care agents, surface and skin care agents. Suitable examples of such other cleaning adjuncts and levels of use are found in U.S. Pat. Nos. 5,576,282, 6,306,812, 6,326,348 and PCT Int. Publ. WO99/05242, the teachings of which are incorporated herein by reference.

Fatty Acids

Similar to that disclosed in U.S. Pat. No. 4,561,998, the detergent compositions may contain a fatty acid containing from about 10 to about 22 carbon atoms. The fatty acid can also contain from about 1 to about 10 ethylene oxide units in the hydrocarbon chain. Suitable fatty acids are saturated and/or unsaturated and can be obtained from natural sources such as plant or animal esters (e.g., palm kernel oil, palm oil, coconut oil, babassu oil, safflower oil, tall oil, castor oil, tallow and fish oils, grease, and mixtures thereof) or synthetically prepared (e.g., via the oxidation of petroleum or by hydrogenation of carbon monoxide via the Fisher-Tropsch process). Examples of suitable saturated fatty acids for use in the detergent compositions include capric, lauric, myristic, palmitic, stearic, arachidic and behenic acid. Suitable unsaturated fatty acid species include: palmitoleic, oleic, linoleic, linolenic and ricinoleic acid. Examples of preferred fatty acids are saturated $C_{10}$-$C_{14}$ (coconut) fatty acids, from about 5:1 to about 1:1 (preferably about 3:1) weight ratio mixtures of lauric and myristic acid, and mixtures of the above lauric/myristic blends with oleic acid at a weight ratio of about 4:1 to about 1:4 mixed lauric/myristic:oleic.

U.S. Pat. No. 4,507,219 identifies various sulfonate surfactants as suitable for use with the above-identified co-surfactants. The disclosures of U.S. Pat. Nos. 4,561,998 and 4,507,219 with respect to co-surfactants are incorporated herein by reference.

Softergents

Softergent technologies as described in, for example, U.S. Pat. Nos. 6,949,498, 5,466,394 and 5,622,925 can be used in the detergent compositions. "Softergent" refers to a softening detergent that can be dosed at the beginning of a wash cycle for the purpose of simultaneously cleaning and softening fabrics. The inventive detergent compositions can be used to make stable, aqueous heavy duty liquid laundry detergent compositions containing a fabric-softening agent that provide exceptional cleaning as well as fabric softening and anti-static benefits.

Some suitable softergent compositions contain about 0.5% to about 10%, preferably from about 2% to about 7%, more preferably from about 3% to about 5% by weight of a quaternary ammonium fabric-softening agent having the formula:

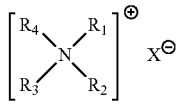

wherein $R_1$ and $R_2$ are individually selected from the group consisting of $C_1$-$C_4$ alkyl, $C_1$-$C_4$ hydroxy alkyl, benzyl, and —$(C_2H_4O)_x$ H where x has a value from 2 to 5; X is an anion; and (1) $R_3$ and $R_4$ are each a $C_8$-$C_{14}$ alkyl or (2) $R_3$ is a $C_8$-$C_{22}$ alkyl and $R_4$ is selected from the group consisting of $C_1$-$C_{10}$ alkyl, C-$C_{10}$ hydroxy alkyl, benzyl, and —$(C_2 H_4O)_x$ H where x has a value from 2 to 5.

Preferred fabric-softening agents are the mono-long chain alkyl quaternary ammonium surfactants wherein in the above formula $R_1$, $R_2$, and $R_3$ are each methyl and $R_4$ is a $C_8$-$C_{18}$ alkyl. The most preferred quaternary ammonium surfactants are the chloride, bromide and methylsulfate $C_8$-$C_{16}$ alkyl trimethyl ammonium salts, and $C_8$-$C_{16}$ alkyl di(hydroxyethyl)-methyl ammonium salts. Of the above, lauryl trimethyl ammonium chloride, myristyl trimethyl ammonium chloride and coconut trimethylammonium chloride and methylsulfate are particularly preferred.

Another class of preferred quaternary ammonium surfactants are the di-$C_8$-$C_{14}$ alkyl dimethyl ammonium chloride or methylsulfates; particularly preferred is di-$C_{12}$-$C_{14}$ alkyl dimethyl ammonium chloride. This class of materials is particularly suited to providing antistatic benefits to fabrics.

A preferred softergent comprises the detergent composition wherein the weight ratio of anionic surfactant component to quaternary ammonium softening agent is from about 3:1 to about 40:1; a more preferred range is from about 5:1 to 20:1.

Odor Control

Odor control technologies as described in, for example, U.S. Pat. No. 6,878,695 can be used in the detergent compositions.

For example, a composition containing the inventive detergent compositions can further comprise a low-degree of substitution cyclodextrin derivative and a perfume material. The cyclodextrin is preferably functionally-available cyclodextrin. The compositions can further comprise optional cyclodextrin-compatible and -incompatible materials, and other optional components. Such a composition can be used for capturing unwanted molecules in a variety of contexts, preferably to control malodors including controlling malodorous molecules on inanimate surfaces, such as fabrics, including carpets, and hard surfaces including countertops, dishes, floors, garbage cans, ceilings, walls, carpet padding, air filters, and the like, and animate surfaces, such as skin and hair.

The low-degree of substitution cyclodextrin derivatives useful herein are preferably selected from low-degree of substitution hydroxyalkyl cyclodextrin, low-degree of substitution alkylated cyclodextrin, and mixtures thereof. Preferred low-degree of substitution hydroxyalkyl beta-cyclodextrins have an average degree of substitution of less than about 5.0, more preferably less than about 4.5, and still more preferably less than about 4.0. Preferred low-degree of substitution alkylated cyclodextrins have an average degree of substitution of less than about 6.0, more preferably less than about 5.5, and still more preferably less than about 5.0.

The detergent compositions can comprise a mixture of cyclodextrins and derivatives thereof such that the mixture effectively has an average degree of substitution equivalent to the low-degree of substitution cyclodextrin derivatives described hereinbefore. Such cyclodextrin mixtures preferably comprise high-degree of substitution cyclodextrin derivatives (having a higher average degree of substitution than the low-degree substitution cyclodextrin derivatives described herein) and non-derivatized cyclodextrin, such that the cyclodextrin mixture effectively has an average degree of substitution equivalent to the low-degree of substitution cyclodextrin derivative. For example, a composition comprising a cyclodextrin mixture containing about 0.1% non-derivatized beta-cyclodextrin and about 0.4% hydroxypropyl beta-cyclodextrin having an average degree of substitution of about 5.5, exhibits an ability to capture unwanted molecules similar to that of a similar composition comprising low-degree of substitution hydroxypropyl beta-cyclodextrin having an average degree of substitution of about 3.3. Such cyclodextrin mixtures can typically absorb odors more broadly by complexing with a wider range of unwanted molecules, especially malodorous molecules, having a wider range of molecular sizes preferably at least a portion of a cyclodextrin mixture is alpha-cyclodextrin and its derivatives thereof, gamma-cyclodextrin and its derivatives thereof, and/or beta-cyclodextrin and its derivatives thereof; more preferably a mixture of alpha-cyclodextrin, or an alpha-cyclodextrin derivative, and derivatized beta-cyclodextrin, even more preferably a mixture of derivatised alpha-cyclodextrin and derivatized beta-cyclodextrin; and most preferably a mixture of hydroxypropyl alpha-cyclodextrin and hydroxypropyl beta-cyclodextrin, and/or a mixture of methylated alpha-cyclodextrin and methylated beta-cyclodextrin.

The cavities within the functionally-available cyclodextrin in the detergent compositions should remain essentially unfilled (i.e., the cyclodextrin remains uncomplexed and free) or filled with only weakly complexing materials when in solution, in order to allow the cyclodextrin to absorb (i.e., complex with) various unwanted molecules, such as malodor molecules, when the composition is applied to a surface containing the unwanted molecules. Non-derivatized (normal) beta-cyclodextrin can be present at a level up to its solubility limit of about 1.85% (about 1.85 g in 100 grams of water) at room temperature. Beta-cyclodextrin is not preferred in compositions which call for a level of cyclodextrin higher than its water solubility limit. Non-derivatized beta-cyclodextrin is generally not preferred when the composition contains surfactant since it affects the surface activity of most of the preferred surfactants that are compatible with the derivatized cyclodextrins.

The level of low-degree of substitution cyclodextrin derivatives that are functionally-available in the odor control compositions is typically at least about 0.001%, preferably at least about 0.01%, and more preferably at least about 0.1%, by weight of the detergent composition. The total level of cyclodextrin in the present composition will be at least equal to or greater than the level of functionally-available cyclodextrin. The level of functionally-available will typically be at least about 10%, preferably at least about 20%, and more preferably at least about 30%, by weight of the total level of cyclodextrin in the composition.

Concentrated compositions can also be used. When a concentrated product is used, i.e., when the total level of cyclodextrin used is from about 3% to about 60%, more preferably from about 5% to about 40%, by weight of the concentrated composition, it is preferable to dilute the concentrated composition before treating fabrics in order to avoid staining. Preferably, the concentrated cyclodextrin composition is diluted with about 50% to about 6000%, more preferably with about 75% to about 2000%, most preferably with about 100% to about 1000% by weight of the concentrated composition of water. The resulting diluted compositions have usage concentrations of total cyclodextrin and functionally-available cyclodextrin as discussed hereinbefore, e.g., of from about 0.1% to about 5%, by weight of the diluted composition of total cyclodextrin and usage concentrations of functionally-available cyclodextrin of at least about 0.001%, by weight of the diluted composition.

Forms

The detergent compositions can take any of a number of forms and any type of delivery system, such as ready-to-use, dilutable, wipes, or the like.

For example, the detergent compositions can be a dilutable fabric detergent, which may be an isotropic liquid, a surfactant-structured liquid, a granular, spray-dried or dry-blended powder, a tablet, a paste, a molded solid, a water soluble sheet, or any other laundry detergent form known to those skilled in the art. A "dilutable" fabric detergent composition is defined, for the purposes of this disclosure, as a product intended to be used by being diluted with water or a non-aqueous solvent by a ratio of more than 100:1, to produce a liquor suitable for treating textiles. "Green concentrate" compositions like those on the market today for Fantastic®, Windex® and the like, can be formulated such that they could be a concentrate to be added to a bottle for final reconstitution.

The detergent compositions can also be formulated as a gel or a gel packet or pod like the dishwasher products on the market today. Water-soluble sheets, sachets, or pods such as those described in U.S. Pat. Appl. No. 2002/0187909, the teachings of which are incorporated herein by reference, are also envisaged as a suitable form. The detergent composition can also be deposited on a wiper or other substrate.

Polymeric Suds Enhancers

In some aspects, polymeric suds enhancers such as those described in U.S. Pat. No. 6,903,064 can be used in the detergent compositions. For example, the compositions may further comprise an effective amount of polymeric suds volume and suds duration enhancers. These polymeric materials provide enhanced suds volume and suds duration during cleaning.

Examples of polymeric suds stabilizers suitable for use in the compositions:

(i) a polymer comprising at least one monomeric unit having the formula:

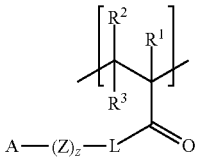

wherein each of $R^1$, $R^2$ and $R^3$ are independently selected from the group consisting of hydrogen, $C_1$ to $C_6$ alkyl, and mixtures thereof; L is O; Z is $CH_2$; z is an integer selected from about 2 to about 12; A is $NR^4R^5$, wherein each of $R^4$ and $R^5$ is independently selected from the group consisting of hydrogen, $C_1$ to $C_8$ alkyl, and mixtures thereof, or $NR^4R^5$ form an heterocyclic ring containing from 4 to 7 carbon atoms, optionally containing additional hetero atoms, optionally fused to a benzene ring, and optionally substituted by $C_1$ to $C_8$ hydrocarbyl;

(ii) a proteinaceous suds stabilizer having an isoelectric point from about 7 to about 11.5;

(iii) a zwitterionic polymeric suds stabilizer; or (iv) mixtures thereof.

Preferably, the exemplary polymeric suds stabilizer described above has a molecular weight of from about 1,000 to about 2,000,000; more preferably the molecular weight is about 5,000 to about 1,000,000.

Other Applications

Although we found that the inventive detergent compositions have considerable value for laundry detergents, other end uses should benefit from their use. Thus, the surfactants should also be valuable in applications where greasy substances require removal or cleaning at low temperature. Such applications include, for example, household cleaners, degreasers, sanitizers and disinfectants, light-duty liquid detergents, hard and soft surface cleaners for household, autodish detergents, rinse aids, laundry additives, carpet cleaners, spot treatments, softergents, liquid and sheet fabric softeners, industrial and institutional cleaners and degreasers, oven cleaners, car washes, transportation cleaners, drain cleaners, industrial cleaners, oil dispersants, foamers, defoamers, institutional cleaners, janitorial cleaners, glass cleaners, graffiti removers, adhesive removers, concrete cleaners, metal/machine parts cleaners, and food service cleaners, and other similar applications for which removal of greasy soils is advantageously accomplished, particularly at room temperature or below. The detergents may also be beneficial for certain personal care applications such as hand soaps and liquid cleansers, shampoos, and other hair/scalp cleansing products, especially for oily/greasy hair, scalp, and skin, which are also beneficial when effective with lukewarm or cold water. Additionally, the detergents may also benefit applications requiring solubilization of active materials, such as agricultural compositions, in which the detergent might function as a solvent, surfactant, or adjuvant.

The following examples merely illustrate the invention; the skilled person will recognize many variations that are within the spirit of the invention and scope of the claims.

Preparation of 4-Mole Butoxylated Diglyceryl Tetraamine

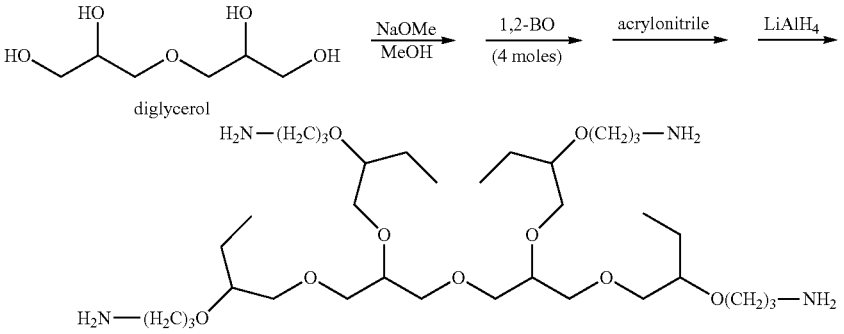

Preparation of 4 Mol Butylene Oxide-Capped Diglycerol

Diglycerol (566 g, product of Solvay) is combined with sodium methoxide (29.1 g of 30% solution in methanol), and the methanol is stripped under vacuum using a rotary evaporator. A portion of the catalyzed diglycerol mixture (148.8 g) is charged to a 600-mL Parr reactor, which is then sealed. The reactor is purged five times with nitrogen (each time charging to 30 psi and releasing the pressure to 5 psi). The reactor contents are heated to 135° C. with stirring (800 rpm) to give a head pressure of 10 psi. 1,2-Butylene oxide ("BO," 255 g total) is then transferred to the reactor from a holding tank in two equal portions using nitrogen. During the BO addition, the pressure in the reactor increases to 80 psi. When the pressure reaches 80 psi, the addition is stopped, and the reactor contents are allowed to digest until the reactor pressure drops to 40 psi.

For the first portion (127.5 g), the addition requires six cycles of 40 psi to 80 psi to complete the addition. After all of the BO had been added to the reactor, the pressure reads 86 psi. The reaction mixture is heated to 150° C. and held at 150° C. for 0.5 h. No pressure drop is observed during this period, indicating that the reaction is complete.

The reaction mixture is cooled to 60° C. and continued the following day by heating the intermediate product to 135° C. and adding the second portion (127.5 g) of BO in the same manner as before. The second addition of BO requires 14 cycles from 50 psi to 80 psi to complete the addition. After addition of the second portion of BO is complete, the mixture is heated to 150° C. and held at 150° C. for 3 h at 86 psi. The reactor contents are then purged with nitrogen and cooled to 60° C. The final product has a hydroxyl value of 489 mg KOH/g (theoretical: 494 mg KOH/g) and a base value of 5.27 mg KOH/g.

Preparation of 8 Mol Butylene Oxide-Capped Diglycerol

A sample of the previously prepared 4 mol BO-capped diglycerol (131.4 g) is reacted with 147.4 g of BO (first 83.4 g, then 64.3 g) in the same manner as described above. Hydroxyl value: 305 mg KOH/g (theoretical: 302 mg KOH/g). Base value: 2.86 mg KOH/g.

Cyanoethylation of Polyglycerol Alkoxylates

The cyanoethylation procedure of U.S. Pat. No. 5,159,101 is generally followed. Thus, a round-bottom flask is charged with a sample of 4 mol BO-capped diglycerol (458.9 g, about 1.0 mol) and 30% sodium methoxide/methanol solution (1.8 g, 10 mol % based on the amount of BO-capped glycerol) and the contents are heated to 40-50° C. Acrylonitrile (212.5 g, 4.0 mol) is added dropwise with stirring, and the reaction mixture is cooled externally as needed to maintain the desired reaction temperature. After the acrylonitrile addition is complete, the mixture is heated to 50-70° C. for 2 h, followed by neutralization of the catalyst with 98% sulfuric acid.

Reduction with Lithium Aluminum Hydride

Reduction of the nitrile intermediate with lithium aluminum hydride to produce the corresponding primary amine product is performed using the procedure reported in *J. Am. Chem. Soc.* 73 (1951) 242. Catalytic hydrogenation can be used as an alternative to LAH reduction.

Preparation of N—BOC-DL-2-Amino-1-Butanol

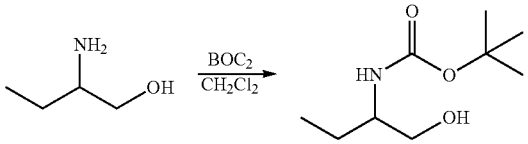

Following a published procedure (B. Morinaka et al., *Org. Lett.* 9 (2007) 5219), racemic 2-amino-1-butanol (49.85 g) is charged to a 2-L, 4-neck reaction flask equipped with a mechanical stirrer, a reflux condenser vented to a mineral oil bubbler, and a thermocouple. Methylene chloride (800 mL) is added, a nitrogen source is attached, the reactor is seated in an ice bath, and the mixture is stirred. Once the temperature reaches 3.0° C., di-tert-butyl dicarbonate ("$BOC_2O$," 114.5 g) in methylene chloride (200 mL) is added dropwise via an addition funnel at a rate that maintains the reaction temperature below 5° C. The addition requires 3.5 h. Once the addition is complete, the reaction mixture is stirred while allowing it to warm to room temperature overnight under a light nitrogen headspace purge.

The contents of the reactor are transferred to a 3-L round-bottom flask. Methylene chloride is removed at 26° C. and 197 mm Hg for 60 min., and then under full vacuum for another 60 min. on a rotary evaporator. The residue (117.2 g) is dissolved in diethyl ether (300 mL) and transferred to a separatory funnel. The flask is rinsed with diethyl ether (2×100 mL), and the rinses are transferred to the funnel. The ether solution is washed successively with 20% aqueous $H_3PO_4$ (2×100 mL), 10% brine solution (100 mL), 5% aqueous $NaHCO_3$(2×100 mL) and 10% brine solution (100 mL). The ether solution is then dried ($Na_2SO_4$), filtered, and concentrated to yield 95.37 g (97%) of a viscous, liquid crude product that is pure enough to proceed to the ring closure reaction. The procedure is repeated twice, and the three products are combined.

Preparation of N—BOC-2-Ethylaziridine

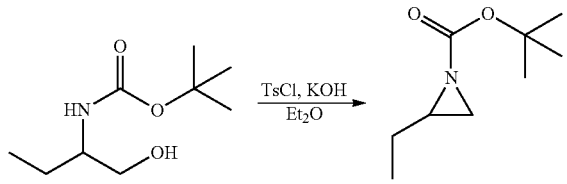

Following a published procedure (P. Wessig et al., *SYNLETT* (1997) 893), tosyl chloride (60.77 g) is added to a stirring solution of N—BOC-DL-2-amino-1-butanol (50.07 g) in diethyl ether (1.0 L) under a nitrogen purge. The mixture is purged with nitrogen for 15 min. in a 2-L, 4-neck reaction flask equipped with a reflux condenser, mechanical stirrer, and a reflux condenser attached to a nitrogen source, and the reactor is seated in a water bath. Powdered KOH (70.50 g, ground in a mortar and pestle) is added in portions over 2.25 h via a solids addition funnel with a Teflon auger at a rate that maintains the temperature at or below room temperature. Once the addition is complete, the reaction mixture is allowed to stir while resting in the water bath overnight.

After stirring for 22 h, the water bath is removed, and the reaction mixture is filtered. The filter cake is rinsed with diethyl ether (2×100 mL), each time into the mother liquor. The combined filtrate is then passed through a plug of diatomaceous earth. The filter cake is rinsed with diethyl ether (2×50 mL), and the rinses are combined with the mother liquor. The solution is concentrated on a rotary evaporator yielding 41.08 g (90.7%) of crude product of sufficient purity. This procedure is repeated 4 times, and the combined products are vacuum distilled. Yield: 153.01 g. Bp: 42-44° C. under full vacuum.

$^1$H NMR spectrum δ (ppm)=2.28 (m, 1H, ring methine proton); 2.20 (d, 1H, ring methylene proton); 1.87 (d, 1H, ring methylene proton); 1.46 (m, integration not possible due to overlap, $CH_3$—$CH_2$—); 1.41 (s, integration not possible due to overlap, t-butyl protons); 0.99 (t, 3H, —$CH_2$—$CH_3$).

Preparation of N—BOC Protected 8-Mole Butoxylated Ether Amine

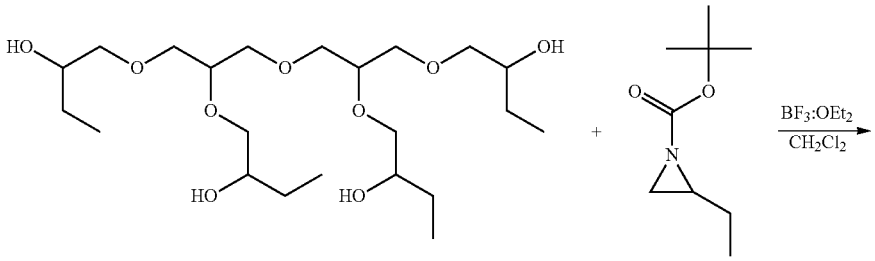

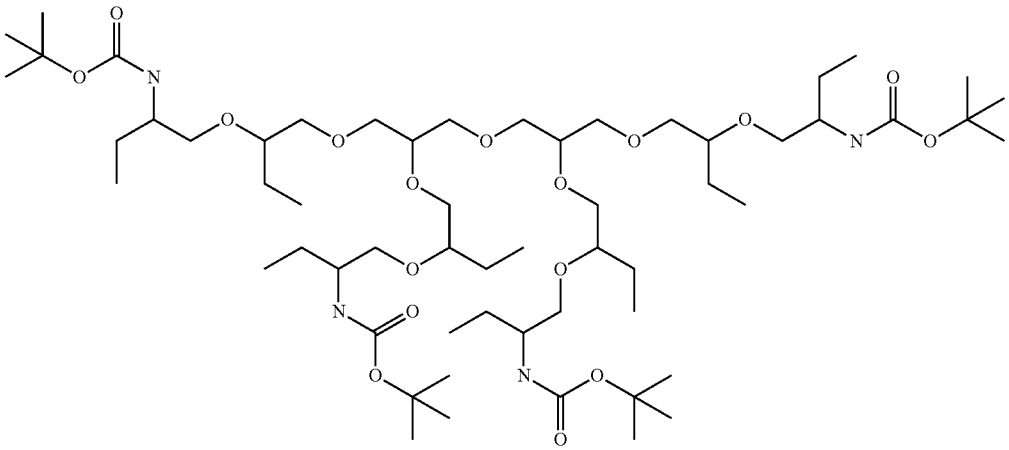

Following a modified procedure developed by Prasad et al. (*Tetrahedron* 58 (2002) 7355), butoxylated diglycerol (4 mole BO, 50.29 g) is charged to a 2-L, 4-neck round-bottom flask equipped with a magnetic stir bar, a thermocouple, and a reflux condenser vented to a mineral oil bubbler. The reactor is attached to a nitrogen source, flushed with nitrogen, and sealed with a rubber septum. While under a nitrogen blanket, boron trifluoride etherate (6.49 g) is added via syringe with stirring. A mild exotherm is observed, as the reaction temperature increases from 19.8° C. to 22.5° C. An addition funnel charged with N—BOC-2-ethylaziridine (77.40 g) is attached to the reactor, which is seated in a water bath. The top of the addition funnel is attached to the nitrogen source, and the reactor is placed under a light nitrogen headspace purge and vented through the reflux condenser to the mineral oil bubbler. The reaction mixture is allowed to cool to 19° C., and then the aziridine is added slowly over 5 h at a rate that maintains the temperature at or below 25° C. The reaction is very exothermic, requiring the aziridine to be added very slowly and periodically stopping the addition to allow heat to dissipate before continuing the addition. Once the addition is complete, progress of the reaction is monitored by $^1$H NMR to observe the disappearance of aziridine ring protons at 1.8, 2.1, and 2.2 ppm. After stirring overnight at room temperature, aziridine functionality persists, so additional $BF_3$ etherate (3.36 g) is added and stirred for 4 h. $^1$H NMR then shows complete conversion of the aziridine compound.

Sodium methoxide solution (59.96 g of 25% NaOMe in methanol) is added dropwise to the reactor from an addition funnel over 1.25 h, keeping the reaction temperature at or below room temperature. Once the addition was complete, the mixture is allowed to stand overnight.

The reactor contents are transferred to a 2000-mL separatory funnel. The reactor is rinsed with methylene chloride (2×50 mL), and the rinses are added to the funnel. The methylene chloride solution is then washed with 5% aqueous $NaHCO_3$(3×150 mL) and deionized water (3×100 mL). The organic phase is dried ($Na_2SO_4$) for 1.5 h. The dried solution is filtered into a tared 3000-mL round-bottom flask and concentrated on a rotary evaporator at 35° C. yielding 120.20 g (94%) of a water-insoluble product. FT-IR: strong carbonyl stretch at 1707 cm$^{-1}$.

Preparation of 8-Mole Butoxylated Diglyceryl Tetraamine Via Deprotection

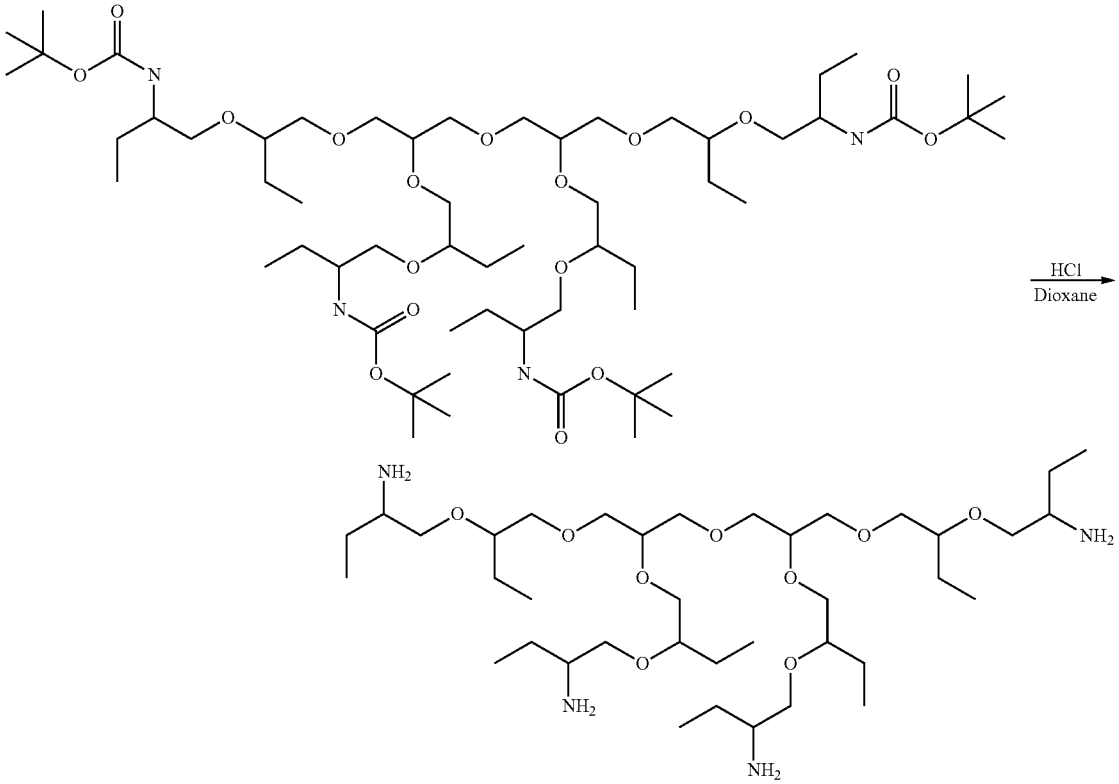

Following a procedure similar to that of Han et al., (*Peptide Res.* 58 (2001) 338), the BOC-protected 8-mole butoxylated ether amine is transferred using dioxane (200 mL) to a 1-L, 4-neck reaction flask equipped with a mechanical stirrer, a thermocouple, and a reflux condenser vented to a mineral oil bubbler. An addition funnel charged with 4 M HCl in dioxane (227.84 g, ~8 theoretical molar equivalents, ~2 equivalents per BOC-protected amine) is attached to the reactor, which is seated in a water bath while stirring. The HCl solution is added over 1.25 h. No exotherm is observed throughout the addition of the HCl solution. Once the addition is complete, the mixture is allowed to stir while monitoring disappearance of the carbonyl stretch in the FT-IR at 1725 $cm^{-1}$.

The reaction mixture is transferred to a tared 3-L round-bottom flask and concentrated. The residue (124.2 g) is diluted with deionized water (350 mL) and swirled until homogeneous. This solution is transferred to a 1-L beaker containing a magnetic stir bar. The flask is rinsed with deionized water (75 mL), and the rinse is added to the beaker. With stirring, the pH of the aqueous solution is adjusted to 10-11 with 50% aqueous NaOH solution. The resulting fine suspension is then transferred to a 1-L separatory funnel. The beaker is rinsed with methylene chloride (100 mL), and the rinse is added the separatory funnel. The aqueous solution is extracted with methylene chloride (4×100 mL). The methylene chloride washings are returned to the separatory funnel and washed with deionized water (2×50 mL). The methylene chloride layer is isolated, dried ($Na_2SO_4$), and concentrated to yield 67.84 g (87%) of a product that is soluble in aqueous acid solutions. Amine value: 156 mg KOH/g sample (51% of the theoretical value).

Preparation of 8-Mole Butoxylated Diglyceryl Tetraamine Via Reductive Amination

Wet Raney 2800 catalyst (300 g) is charged to a one-gallon autoclave under a nitrogen atmosphere. The catalyst is dried in the vessel by purging with nitrogen while warming the autoclave walls overnight. Butylene oxide-capped diglycerol (102 g, 8.0 mol) is charged to the vessel using nitrogen pressure and then anhydrous tetrahydrofuran (235 g) is added. Liquid ammonia (315 g) is added and the vessel is pressurized to 400 psig with hydrogen. The vessel is heated to 205° C. with stirring. Once at temperature, the vessel is pressurized to 4000 psig with hydrogen and stirred in this state for 3 hours.

The vessel is cooled to below 30° C. and pressure is vented to a scrubber. The headspace is swept with nitrogen, the reaction slurry is pushed out of the reactor with nitrogen, and the organic solution is decanted, filtered, and concentrated to yield 68.5 g of product with a degree of amination of 57.5%.

Procedure for Testing Laundry Detergent Samples

Laundry detergent (to give 0.1% actives in washing solution) is charged to the washing machine, followed by soiled/stained fabric swatches that are attached to pillowcases. Wash temperature: 60° F. Rinse temperature: 60° F. The swatches are detached from pillowcases, dried, and ironed. Swatches are scanned to measure the L* a* b* values, which are used to calculate a stain removal index (SRI) for each type of swatch. Finally, the ΔSRI is calculated, which equals the experimental sample SRI minus the SRI of a pre-determined standard laundry detergent formula (or control). When $|\Delta SRI| \geq 0.5$ differences are perceivable to the naked eye. If the value of ΔSRI is greater than or equal to 0.5, the sample is superior. If ΔSRI is less than or equal to −0.5, the sample is inferior. If ΔSRI is greater than −0.5 and less than 0.5, the sample is considered equal to the standard.

The following standard soiled/stained fabric swatches are used: bacon grease, butter, cooked beef fat, and beef tallow on cotton fabric. At least three swatches of each kind are used per wash. Swatches are stapled to pillowcases for laundering, and extra pillowcases are included to complete a six-pound load.

The same procedure is used to launder all of the pillowcases/swatches, with care taken to ensure that water temperature, wash time, manner of addition, etc. are held constant for the cold-water wash process. When the cycle is complete, swatches are removed from the pillowcases, dried at low heat on a rack, and pressed gently and briefly with a dry iron.

A Hunter LabScan® XE spectrophotometer is used to determine the L*a*b* values to calculate the SRI for every type of swatch, and the stain removal index (SRI) is calculated as follows:

$$SRI=100-\sqrt{(L^*_{clean}-L^*_{washed})^2+(a^*_{clean}-a^*_{washed})^2+(b^*_{clean}-b^*_{washed})^2}$$

$$\Delta SRI=SRI_{sample}-SRI_{standard}$$

Performance results for cold-water cleaning of cotton fabric treated with bacon grease, cooked beef fat, and beef tallow greasy soils are compared. All formulations are tested at 0.1% actives levels. Wash cycles are 30 min in front-loading, high-efficiency washing machines. Laundry formulations were tested with and without inventive polyetheramine added.

Tables 1 and 2 provide formulation details using two different controls. Control 1 uses less nonionic surfactant and less NaAES. Control 2 uses more nonionic surfactant and more NaAES. Tables 3 and 4 provide the cleaning performance results. In each case, inclusion of the diglycerol-based polyetheramine component provides enhanced cleaning performance versus the control.

TABLE 1

Laundry Detergent Formulations

| | Formulations | | | |
|---|---|---|---|---|
| | Control 1 wt. % active | A wt. % active | B wt. % active | C wt. % active |
| Ingredient (100% active) | | | | |
| Polyetheramine[1] | — | 1.0 | 2.0 | 3.0 |
| Neodol ® 25-7[2] | 4.8 | 4.8 | 4.8 | 4.8 |
| Sodium $C_{12}$-$C_{15}$ alcohol ethoxylate (3 EO) sulfate (27.66%), NaAES (3EO) | 2.6 | 2.6 | 2.6 | 2.6 |
| Bio-Soft ® S-101[3], HLAS | 7.5 | 7.5 | 7.5 | 7.5 |
| NaOH | 3.7 | 3.7 | 3.7 | 3.7 |
| Hardened coconut fatty acid | 3.1 | 3.1 | 3.1 | 3.1 |
| Monoethanolamine | 0.3 | 0.3 | 0.3 | 0.3 |
| Citric acid | 3.2 | 3.2 | 3.2 | 3.2 |
| Deionized water | 74.8 | 73.8 | 72.8 | 71.8 |
| adjusted pH | 7.2 | 7.2 | 7.2 | 7.2 |

[1]Polyetheramine = diglycerol reacted with 8 moles of 1,2-butylene oxide, followed by amination of the free hydroxyl groups via deprotection.
[2]Product of Shell.
[3]Product of Stepan Company.

TABLE 2

Laundry Detergent Formulations

| | Formulations | | | |
|---|---|---|---|---|
| | Control 2 wt. % active | D wt. % active | E wt. % active | F wt. % active |
| Ingredient (100% active) | | | | |
| Polyetheramine[1] | — | 1.0 | 3.0 | 4.0 |
| Neodol ® 25-7[2] | 11.9 | 11.9 | 11.9 | 11.9 |
| Sodium $C_{12}$-$C_{14}$ alcohol ethoxylate (3 EO) sulfate (27.66%), NaAES (3EO) | 7.7 | 7.7 | 7.7 | 7.7 |
| Bio-Soft ® S-101[3], HLAS | 7.9 | 7.9 | 7.9 | 7.9 |
| NaOH | 0.6 | 0.6 | 0.6 | 0.6 |
| Hardened coconut fatty acid | 3.0 | 3.0 | 3.0 | 3.0 |
| Monoethanolamine | 2.1 | 2.1 | 2.1 | 2.1 |
| Sodium citrate dehydrate | 3.5 | 3.5 | 3.5 | 3.5 |
| Stepanate ® SCS[4] (44.9%) (Na cumene sulfonate) | 1.1 | 1.1 | 1.11 | 1.11 |
| Deionized water | 62.2 | 61.2 | 59.2 | 58.2 |
| adjusted pH | 7.2 | 7.2 | 7.2 | 7.2 |

[1]Polyetheramine = diglycerol reacted with 8 moles of 1,2-butylene oxide, followed by amination of the free hydroxyl groups via deprotection.
[2]Product of Shell.
[3,4]Products of Stepan Company.

TABLE 3

Performance in Cold-Water Cleaning Greasy Soil Stain Set

| | ΔSRI of Cleaning Data: Cold water wash/rinse Detergency for Individual Soils (ΔSRI) | | | | |
|---|---|---|---|---|---|
| Test formulation (0.1% actives) | Beef Tallow | Cooked Beef Fat | Bacon Grease | Butter | Overall ΔSRI |
| Control 1 | 0.0 | 0.0 | 0.0 | 0.0 | 0.0 |
| Formulation A | 0.5 | 0.2 | 1.2 | 0.2 | 2.1 |
| Formulation B | 8.6 | 0.6 | 0.5 | 0.2 | 9.9 |
| Formulation C | 12.0 | 2.5 | 1.1 | 0.4 | 16.0 |

Test conditions: front-loading washing machine; surfactant concentration: 1000 ppm; wash/rinse temperature: 60° F./60° F.; wash/rinse time: 30 min./20 min.; total load: 6 lb.

TABLE 4

Performance in Cold-Water Cleaning Greasy Soil Stain Set

| Test | ΔSRI of Cleaning Data: Cold water wash/rinse Detergency for Individual Soils (ΔSRI) | | | | |
|---|---|---|---|---|---|
| formulation (0.1% actives) | Beef Tallow | Cooked Beef Fat | Bacon Grease | Butter | Overall ΔSRI |
| Control 2 | 0.0 | 0.0 | 0.0 | 0.0 | 0.0 |
| Formulation D | 1.5 | 0.8 | 0.3 | 2.9 | 5.5 |
| Formulation E | 4.0 | 2.2 | 0.9 | 3.2 | 10.3 |
| Formulation F | 5.5 | 1.9 | 1.4 | 3.2 | 12.0 |

Test conditions: front-loading washing machine; surfactant concentration: 1000 ppm; wash/rinse temperature: 60° F./60° F.; wash/rinse time: 30 min./20 min.; total load: 6 lb.

TABLE 5

Laundry Detergent Formulations

| | Formulations | | | |
|---|---|---|---|---|
| | Control 1 wt. % active | G wt. % active | H wt. % active | I wt. % active |
| Ingredient (100% active) | | | | |
| Polyetheramine[1] | — | 1.0 | 2.0 | 3.0 |
| Neodol ® 25-7[2] | 4.8 | 4.8 | 4.8 | 4.8 |
| Sodium $C_{12}$-$C_{15}$ alcohol ethoxylate (3 EO) sulfate (27.66%), NaAES (3EO) | 2.6 | 2.6 | 2.6 | 2.6 |
| Bio-Soft ® S-101[3], HLAS | 7.5 | 7.5 | 7.5 | 7.5 |
| NaOH | 3.7 | 3.7 | 3.7 | 3.7 |
| Hardened coconut fatty acid | 3.1 | 3.1 | 3.1 | 3.1 |
| Monoethanolamine | 0.3 | 0.3 | 0.3 | 0.3 |
| Citric acid | 3.2 | 3.2 | 3.2 | 3.2 |
| Deionized water | 74.8 | 73.8 | 72.8 | 71.8 |
| adjusted pH | 7.2 | 7.2 | 7.2 | 7.2 |

[1]Polyetheramine = diglycerol reacted with 8 moles of 1,2-butylene oxide, followed by amination of the free hydroxyl groups via reductive amination.
[2]Product of Shell.
[3]Product of Stepan Company.

TABLE 6

Performance in Cold-Water Cleaning Greasy Soil Stain Set

| | ΔSRI of Cleaning Data: Cold water wash/rinse Detergency for Individual Soils (ΔSRI) | | |
|---|---|---|---|
| Test formulation (0.1% actives) | Beef Tallow | Cooked Beef Fat | Overall ΔSRI |
| Control 1 | 0.0 | 0.0 | 0.0 |
| Formulation G | 0.8 | 2.2 | 3.0 |
| Formulation H | 7.6 | 1.1 | 8.8 |
| Formulation I | 7.1 | 3.1 | 10.2 |

Test conditions: front-loading washing machine; surfactant concentration: 1000 ppm; wash/rinse temperature: 60° F./60° F.; wash/rinse time: 30 min./20 min.; total load: 6 lb.

The preceding examples are meant only as illustrations; the following claims define the inventive subject matter.

We claim:

1. A detergent composition comprising:

(a) one or more anionic, nonionic, amphoteric, zwitterionic, or cationic surfactants or combinations thereof; and (b) a polyetheramine composition comprising a compound having a polyglycerol core, an aminoalkyl or oxidized aminoalkyl group bonded directly or indirectly to each available oxygen of the polyglycerol core, and optionally one or more oxyalkylene groups linking available oxygens of the polyglycerol core to the aminoalkyl or oxidized aminoalkyl groups.

2. The composition of claim 1 wherein the polyglycerol core is based on diglycerol or a mixture of diglycerol with higher polyglycerols.

3. The composition of claim 1 wherein the polyglycerol core is based on diglycerol.

4. The composition of claim 1 wherein the oxyalkylene units are oxyethylene units, oxypropylene units, oxybutylene units, or combinations thereof.

5. The composition of claim 1 wherein the polyetheramine composition comprises a compound of the formula:

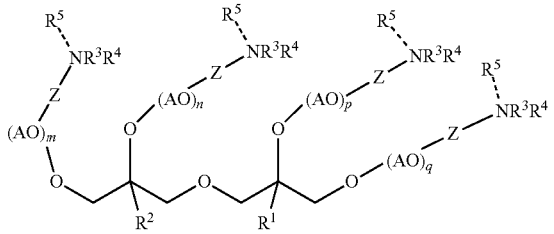

wherein each of $R^1$ and $R^2$ is independently H or $C_1$-$C_4$ alkyl; each AO is independently oxyethylene, oxypropylene, oxybutylene, or a combination thereof; each of m, n, p, and q has an average value within the range of 0 to 10; each Z is independently a linear or branched $C_2$-$C_8$ bridging group; each of $R^3$ and $R^4$ is independently H or $C_1$-$C_{10}$ alkyl; and each $R^5$ is independently an optional oxygen atom such that when $R^5$ is present, it is part of an amine oxide group.

6. The composition of claim 1 wherein the polyetheramine composition comprises a compound of the formula:

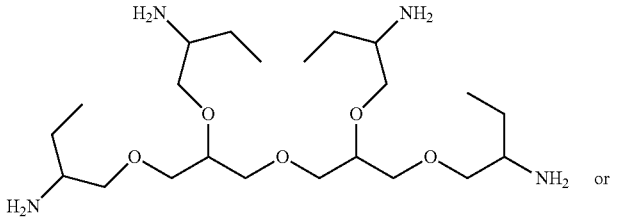

or

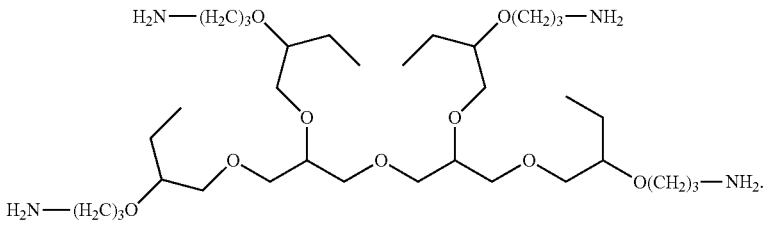

7. The composition of claim 1 wherein the polyetheramine composition comprises a compound of the formula:

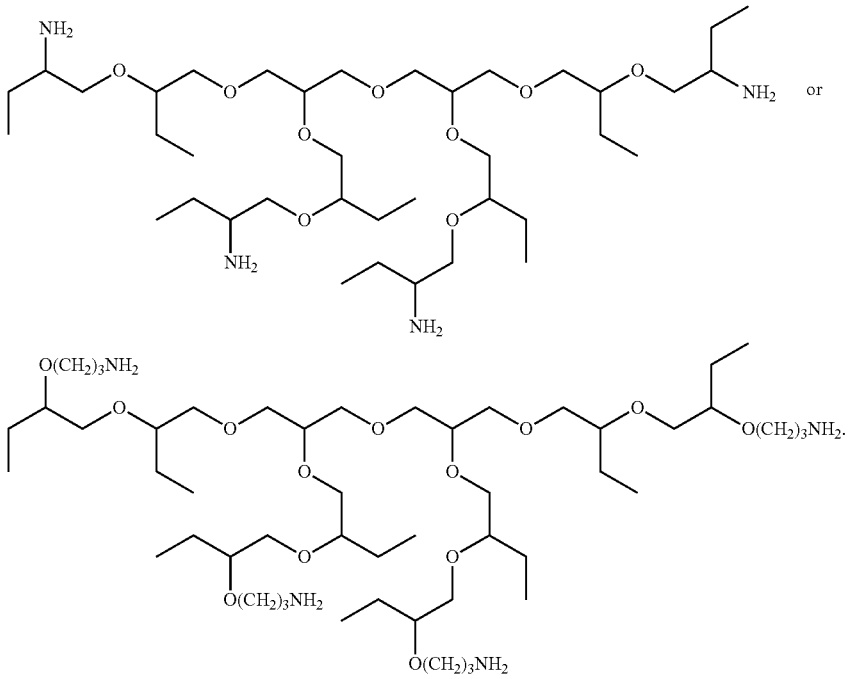

8. A laundry detergent composition comprising the composition of claim 1 and one or more adjuvants selected from the group consisting of builders, alkalinity agents, enzymes, soil-suspending agents, soil-release agents, anti-redeposition agents, dispersants, suds suppressors, suds enhancers, perfumes, hydrotropes, bleaches, optical brighteners, fatty acids, softergents, odor control agents, and combinations thereof.

9. The composition of claim 1 wherein the anionic surfactant is selected from the group consisting of linear alkylbenzene sulfonates, fatty alcohol sulfates, fatty alcohol ether sulfates, and mixtures thereof.

10. The composition of claim 1 wherein the nonionic surfactant is selected from the group consisting of fatty alcohol ethoxylates and alkyl polyglucosides.

11. The composition of claim 1 further comprising water.

12. A liquid, powder, paste, granule, tablet, molded solid, water-soluble sheet, water-soluble sachet, capsule, or water-soluble pod comprising the composition of claim 1.

13. A method which comprises laundering one or more textile articles in water in the presence of the composition of claim 1.

14. The method of claim 13 wherein the water has a temperature less than or equal to 30° C.

15. The method of claim 14 wherein the water has a temperature within the range of 5° C. to 30° C.

16. A method which comprises:

(a) pre-spotting or pre-soaking one or more textile articles with the composition of claim 1; and (b) washing the articles in cold water manually or by machine.

17. A method which comprises formulating a laundry product or formulation that includes the composition of claim 1 as an additive or booster component in an amount effective to improve the grease cutting or grease removal performance of the laundry product or formulation.

18. A method which comprises liquefying a greasy soil in water at a temperature less than 30° C. in the presence of the composition of claim 1.

19. The method of claim 18 wherein the soil is selected from the group consisting of beef tallow, bacon grease, butter, cooked beef fat, and mixtures thereof.

20. The method of claim 18 wherein the soil is liquefied in water at a temperature within the range of 5° C. to 25° C.

* * * * *